US007648229B2

(12) United States Patent
Miyazawa et al.

(10) Patent No.: US 7,648,229 B2
(45) Date of Patent: Jan. 19, 2010

(54) LIQUID JET HEAD AND ITS MANUFACTURING METHOD

(75) Inventors: Hiromu Miyazawa, Azumino (JP); Masao Nakayama, Chino (JP)

(73) Assignee: Seiko Epson Corporation (JP)

( * ) Notice: Subject to any disclaimer, the term of this patent is extended or adjusted under 35 U.S.C. 154(b) by 339 days.

(21) Appl. No.: 11/831,178

(22) Filed: Jul. 31, 2007

(65) Prior Publication Data

US 2008/0030551 A1 Feb. 7, 2008

(30) Foreign Application Priority Data

Aug. 2, 2006 (JP) ..... 2006-211111
Nov. 24, 2006 (JP) ..... 2006-316720

(51) Int. Cl.
*B41J 2/045* (2006.01)

(52) U.S. Cl. ..... 347/71

(58) Field of Classification Search ..... 347/71, 347/68–70, 72–73; 400/124.16, 124.17; 310/363–366; 29/25.35
See application file for complete search history.

(56) References Cited

U.S. PATENT DOCUMENTS

| | | | | |
|---|---|---|---|---|
| 5,461,003 | A | 10/1995 | Havemann et al. | |
| 5,668,398 | A | 9/1997 | Havemann et al. | |
| 5,936,295 | A | 8/1999 | Havemann et al. | |
| 6,231,169 | B1 | 5/2001 | Yazaki et al. | |
| 6,332,672 | B1 | 12/2001 | Yazaki et al. | |
| 6,533,402 | B2 | 3/2003 | Miyata | |
| 6,713,235 | B1 | 3/2004 | Ide et al. | |
| 2006/0077229 | A1 * | 4/2006 | Yokouchi | 347/68 |
| 2006/0249070 | A1 | 11/2006 | Morrison et al. | |
| 2006/0267109 | A1 | 11/2006 | Ohguro | |
| 2007/0058004 | A1 * | 3/2007 | Enomoto et al. | 347/68 |
| 2008/0012907 | A1 * | 1/2008 | Takahashi | 347/68 |

FOREIGN PATENT DOCUMENTS

| | | |
|---|---|---|
| JP | 08-083839 | 3/1996 |
| JP | 11-198369 | 7/1999 |
| JP | 11-207959 | 8/1999 |
| JP | 11-320871 | 11/1999 |
| JP | 2001-138511 | 5/2001 |
| JP | 2002-160366 | 6/2002 |
| JP | 2004-082623 | 3/2004 |
| JP | 2004-130558 | 4/2004 |
| JP | 2004-212289 | 7/2004 |
| JP | 2005-178293 | 7/2005 |
| JP | 2006-517735 | 7/2006 |
| JP | 2006-326806 | 12/2006 |
| WO | 00-60652 | 10/2000 |

* cited by examiner

*Primary Examiner*—K. Feggins
(74) *Attorney, Agent, or Firm*—Harness, Dickey & Pierce, P.L.C.

(57) ABSTRACT

A liquid jet head includes: a substrate; a pressure generation chamber provided in the substrate; an elastic plate provided above the substrate; a capacitor structure section provided above the elastic plate, the capacitor structure section including a lower electrode layer, a piezoelectric layer and an upper electrode layer; a porous layer provided above the capacitor structure section; a seal layer provided on the porous layer; and a void section formed between the capacitor structure section and the porous layer.

16 Claims, 18 Drawing Sheets

LIQUID JET HEAD AND ITS MANUFACTURING METHOD

BACKGROUND

1. Technical Field

The present invention relates to a liquid jetting head and a method for manufacturing the same.

2. Related Art

At present, ink jet methods have been put in practical use as high definition, high-speed printing methods. A device that discharges ink droplets is called an ink jet head, which is an important member in the ink jet method and is being actively studied. Among the methods for jetting ink droplets, a method in which an ink jet head is provided with a piezoelectric is one of the most useful methods. In an inkjet head, a piezoelectric may be interposed between electrodes, thereby forming a capacitor structure. As a typical piezoelectric material, lead zirconate titanate (PZT) ($Pb(Zr_{1-x}Ti_x)$) that is a perovskite type oxide may be enumerated.

It is necessary to suppress leakage current as much as possible in order for an ink jet head to maintain its mechanical reliability. One of the major causes that increase the leakage current is moisture in the atmosphere that adheres to side surfaces of the capacitor structure. Adhesion of moisture in the atmosphere to the side surfaces of the capacitor structure may cause a problem in that leakage current may be generated across electrodes at both ends of the capacitor through the side surfaces, which may eventually lead to dielectric breakdown.

A variety of measures has been developed for suppressing leakage current. For example, Japanese Laid-open Patent Application JP-A-2001-138511 proposes an ink jet recording head in which a lid-like cover is formed with a thin film that does not directly contact its capacitor structure, and dry fluid of inert gas is contained in the cover, whereby the air atmosphere does not contact the piezoelectric. However, the ink jet recording head described in Japanese Laid-open Patent Application JP-A-2001-138511 still entails problems in its method for solution and manufacturing method. In the method described in the document, resist films are removed by a wet process, such that contact with the atmosphere cannot be avoided. Furthermore, the document describes that holes are opened in the lid-like cover that covers the capacitor structure, etching is conducted using the holes, and then the holes are again filled with adhesive. However, such a process requires positional accuracy, and may not necessarily be an easy manufacturing method.

SUMMARY

In accordance with an aspect of the present invention, a liquid jet head in accordance with a first embodiment of the invention includes:

a substrate;

a pressure generation chamber provided in the substrate;

an elastic plate provided above the substrate;

a capacitor structure section provided above the elastic plate, the capacitor structure section including a lower electrode layer, a piezoelectric layer and an upper electrode layer;

a porous layer provided above the capacitor structure section;

a seal layer provided on the porous layer; and a void section formed between the capacitor structure section and the porous layer.

A method for manufacturing a liquid jet head in accordance with a second embodiment of the invention includes the steps of:

(a) sequentially forming, above a substrate, an elastic plate, a lower electrode layer, a piezoelectric layer and an upper electrode layer;

(b) patterning the piezoelectric layer and the upper electrode layer to thereby form a capacitor structure section;

(c) forming a resist layer that covers the capacitor structure section;

(d) forming a porous layer that covers the resist layer;

(e) supplying a gas through pores of the porous layer to remove the resist layer by an ashing method;

(f) forming a seal layer that covers the porous layer; and (g) forming a pressure generation chamber in the substrate.

DESCRIPTION OF EXEMPLARY EMBODIMENTS

Figure 1:
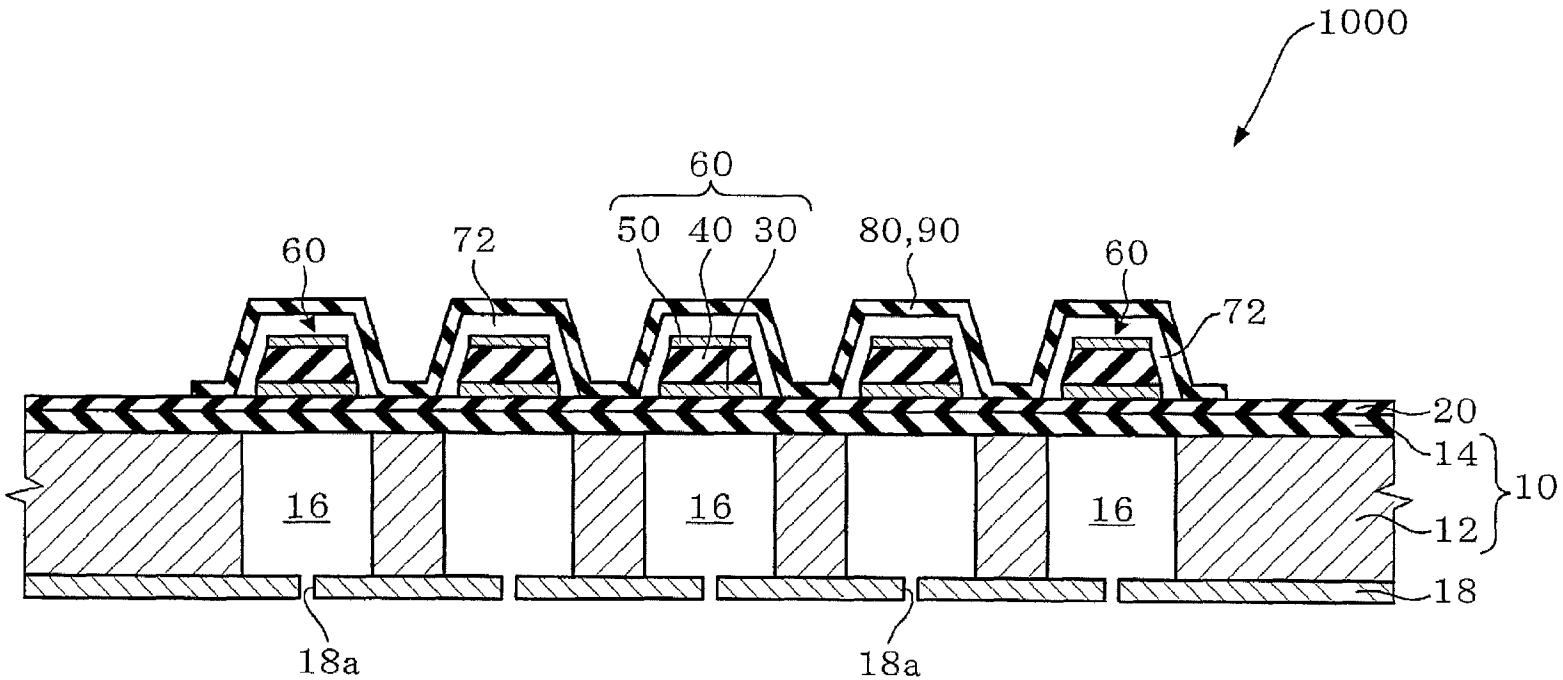
FIG. 1 is a schematic cross-sectional view of a liquid jet head 1000 in accordance with a first embodiment of the invention.

In accordance with an aspect of the present invention, it is possible to provide a liquid jet head that can prevent its capacitor structure from deteriorating, and its manufacturing method.

In accordance with an embodiment of the invention, a liquid jet head includes a substrate;

a pressure generation chamber provided in the substrate;

an elastic plate provided above the substrate;

a capacitor structure section provided above the elastic plate, the capacitor structure section including a lower electrode layer, a piezoelectric layer and an upper electrode layer;

a porous layer provided above the capacitor structure section;

a seal layer provided on the porous layer; and a void section formed between the capacitor structure section and the porous layer.

According to the structure described above, the capacitor structure section is formed inside the sealed void section, such that a liquid jet head including the capacitor structure section whose deterioration is suppressed can be provided.

The liquid jet head described above may further include a protection layer provided at least on a side surface of the capacitor structure section.

In the liquid jet head described above, the protection layer may have an opening section in an upper surface of the capacitor structure section.

In the liquid jet head described above, the protection layer may be formed on the upper surface and the side surface of the capacitor structure section.

In the liquid jet head described above, the protection layer has a film thickness that may be smaller than a film thickness of the seal layer.

In the liquid jet head described above, the film thickness of the protection layer may be 0.1 μm or less.

In the liquid jet head described above, the porous layer may be provided without contacting the capacitor structure section.

In the liquid jet head described above, the void section may be at a pressure smaller than the atmospheric pressure.

In the liquid jet head described above, the substrate may have a dielectric layer at an upper section thereof.

In the liquid jet head described above, the porous layer may be composed of a material selected from the group consisting of oxide, nitride and organic substance.

In the liquid jet head described above, the oxide may be aluminum oxide.

In the liquid jet head described above, each one of the capacitor structure sections may be provided in each one of the void sections.

In the liquid jet head described above, a plurality of the capacitor structure sections may be provided in each one of the void sections.

A method for manufacturing a liquid jet head in accordance with an embodiment of the invention includes the steps of:

(a) sequentially forming, above a substrate, an elastic plate, a lower electrode layer, a piezoelectric layer and an upper electrode layer;

(b) patterning the piezoelectric layer and the upper electrode layer to thereby form a capacitor structure section;

(c) forming a resist layer that covers the capacitor structure section;

(d) forming a porous layer that covers the resist layer;

(e) supplying a gas through pores of the porous layer to remove the resist layer by an ashing method;

(f) forming a seal layer that covers the porous layer; and (g) forming a pressure generation chamber in the substrate.

According to the manufacturing method described above, the capacitor structure section is formed inside the sealed void section, such that it is possible to manufacture an inkjet head including the capacitor structure section whose deterioration is suppressed.

The method for manufacturing a liquid jet head may further include, between the steps (b) and (c), the step (h) of forming a protection layer that covers the capacitor structure section, wherein, in the step (c), the resist layer that covers the capacitor structure section and the protection layer may be formed.

In the method for manufacturing a liquid jet head, a portion of the protection layer formed on an upper surface of the capacitor structure section may be removed by patterning the protection layer between the step (h) and the step (c).

Preferred embodiments of the invention are further described below with reference to the accompanying drawings.

1. First Embodiment 1.1. Liquid Jet Head

Figure 11:
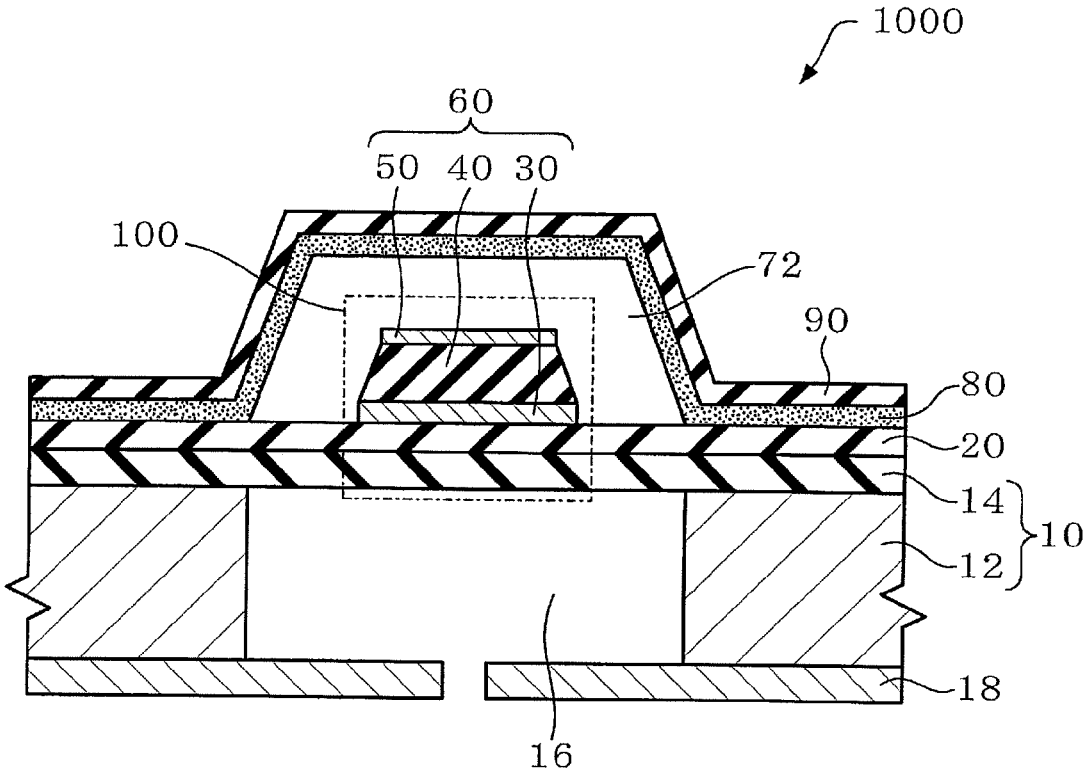
FIG. 11 is a schematic cross-sectional view showing the main part of the liquid jet head 1000 in accordance with the first embodiment.

FIG. 1 is a schematic cross-sectional view of a liquid jet head 1000 in accordance with an embodiment. FIG. 11 is a schematic cross-sectional view in enlargement of a main portion of the liquid jet head 1000.

The liquid jet head 1000 in accordance with the present embodiment includes a substrate 10, pressure generation chambers 16 provided in the substrate 10, an elastic plate 20 provided above the substrate 10, capacitor structure sections 60 provided above the elastic plate 20, each of the capacitor structure sections 60 having a lower electrode layer 30, a piezoelectric layer 40 and an upper electrode layer 50, a porous layer 80 provided above the elastic plate 20 without contacting the capacitor structure sections 60, and a seal layer 90 provided on the porous layer 80. A void section 72 is formed between each of the capacitor structure sections 60 and the porous layer 80. Also, as shown in FIG. 11, a portion formed from each of the capacitor structure sections 60 and a moveable section therebelow is called an actuator section 100 indicated by a dot-and-dash line.

The substrate 10 functions as a support member that supports the liquid jet head 1000 in accordance with the present embodiment. The pressure generation chambers 16 are provided in portion of the substrate 10. The substrate 10 is provided with a nozzle plate 18 at its lower section. As the material of the substrate 10, conductive material, semiconductor material or dielectric material may be used. Among these materials, the substrate 10 may preferably be composed of a material that can be anisotropically etched, which is suitable for the process for forming pressure generation chambers 16. Further, oxidation treatment may be applied to an upper portion of the substrate 10, thereby providing an oxide layer 14. Alternatively, a separate oxide layer 14 may be independently provided by a known method. When the oxide layer 14 is provided at the substrate 10, the oxide layer 14 can be provided with a function as an etching stopper layer against etching from the lower side of the substrate 10, as described below. Also, the oxide layer 14 has a function to enhance the strength of the elastic plate 20. The substrate 10 may preferably have the functions described above, and for example, a silicon substrate may preferably be used. As the substrate 10, for example, a silicon substrate formed with a silicon oxide layer having a thickness of 1000 nm as the oxide layer 14 may be used. It is noted that the substrate 10 is appended with a reference numeral combining the silicon layer 12 and the oxide layer 14, as shown in FIG. 1 and FIG. 11.

The pressure generation chambers 16 are formed in the substrate 10 below the corresponding capacitor structure sections 60, respectively, as shown in FIG. 11. The lower wall of the pressure generation chambers 16 is the nozzle plate 18, as shown in FIG. 1 and FIG. 11. When the liquid jet head 100 is driven, the pressure generation chambers 16 are filled with liquid. The liquid that fills the pressure generation chambers 16 is pressurized by the operation of the actuator section 100. The pressure generation chambers 16 function to discharge the liquid by the pressure through aperture sections 18*a* of the nozzle plate 18.

The nozzle plate 18 is provided below the substrate 10. The nozzle plate 18 functions as the lower wall of the pressure generation chambers 16. The nozzle plate 18 has the aperture sections 18*a* provided at the corresponding pressure generation chambers for discharging liquid, respectively. The nozzle plate 18 may be composed of any material without any particular limitation, and may preferably be composed of stainless steel.

The elastic plate 20 is provided above the substrate 10. When the oxide layer 14 is present on the surface of the substrate 10 as described above, the elastic plate is provided on the layer. The elastic plate is in contact with the capacitor structure sections 60, thereby forming the actuator sections 100 (see FIG. 11).

The elastic plate 20 functions to add elasticity for causing flexural vibration to the actuator section 100. Also, the elastic plate 20 deforms by operation of the capacitor structure section 60 thereby functioning to change the volume of the pressure generation chamber 16. In other words, as the volume of the pressure generation chamber 16 that is filled with liquid becomes smaller, the pressure inside the pressure generation chamber 16 becomes greater, and the liquid is discharged through the aperture section 18*a* of the nozzle plate 18 therebelow. The elastic plate 20 may be composed of any material without any particular limitation, but may preferably be composed of a material having a high mechanical strength. The elastic plate 20 is formed to have an appropriate thickness optimally selected according to the elastic modules of the material used and other factors (for example, the characteristic of the oxide layer 14). As the material of the elastic plate 20, for example, zirconium oxide, silicon nitride, silicon oxide or aluminum oxide may be suitable. When the oxide layer 14 is provided on the upper surface of the substrate 10, the material of the elastic plate 20 may be the same as or different from the material of the oxide layer 14. For example, the elastic plate 20 may be composed of zirconium oxide, and may be formed by a sputter method to a thickness of 500 nm.

The capacitor structure section 60 is formed by laminating the lower electrode layer 30, the piezoelectric layer 40 and the upper electrode layer 50 in this order.

The lower electrode layer 30 is formed on and in contact with the elastic plate 20. The lower electrode layer 30 may have any arbitrary thickness within the range in which deformation of the piezoelectric layer 40 can be transmitted at least to the elastic plate 20. The lower electrode layer 30 may have a thickness, for example, between 200 nm and 800 nm. The lower electrode layer 30 pairs with the upper electrode layer 50 to interpose the piezoelectric layer 40 in between, and functions as one of the electrodes of the capacitor structure section 60. The material of the lower electrode layer 30 is not particularly limited, as long as the material has a conductivity that satisfies the aforementioned function. As the material of the lower electrode layer 30, various kinds of metals, such as, nickel, iridium and platinum, their conductive oxides (for example, iridium oxide and the like), complex oxide of strontium and ruthenium, and the like can be used. Also, the lower electrode layer 30 may be in a single layer of any of the materials exemplified above, or in a laminated layered structure of a plurality of the materials. For example, the lower electrode layer 30 may be composed of platinum, and may be formed by a sputter method to a thickness of 500 nm.

The piezoelectric layer 40 is formed on and in contact with the lower electrode 30. The thickness of the piezoelectric layer 40 may need to be between 500 nm and 1500 nm in order to maintain its mechanical reliability. The piezoelectric layer 40 deforms (i.e., expands and contracts) in its longitudinal direction upon application of an electric field by the lower electrode layer 30 and the upper electrode layer 50, thereby functioning to drive the actuator section 100. The piezoelectric layer 40 may be composed of materials having piezoelectricity. The material of the piezoelectric layer 40 may preferably be an oxide including zinc, zirconium and titanium as its constituent elements. More specifically, lead zirconate titanate (hereafter referred to as PZT) has an excellent piezoelectricity, and is suitable as the material of the piezoelectric layer 40. For example, the piezoelectric layer 40 may be composed of PZT, and formed to a thickness of 1000 nm.

The upper electrode layer 50 is formed on and in contact with the piezoelectric layer 40. The thickness of the upper electrode layer 50 is not limited as long as it is within the range in which the operation of the actuator section 100 is not adversely affected. The upper electrode layer 50 may have a thickness, for example, between 200 nm and 800 nm. The upper electrode layer 50 pairs with the lower electrode layer 30, and functions as one of the electrodes of the capacitor structure section 60. The material of the upper electrode layer 50 is not particularly limited, as long as the material has a conductivity that satisfies the aforementioned function. As the material of the upper electrode layer 50, various kinds of metals, such as, nickel, iridium and platinum, their conductive oxides (for example, iridium oxide and the like), complex oxide of strontium and ruthenium, and the like may be used. Also, the upper electrode layer 50 may be in a single layer of any of the materials exemplified above, or in a laminated layered structure of a plurality of the materials. For example, the upper electrode layer 50 may be composed of platinum, and may be formed by a sputter method to a thickness of 500 nm.

The porous layer 80 is provided above the elastic plate 20 without contacting the capacitor structure section 60, as shown in FIG. 1 and FIG. 11. FIG. 1 illustrates the porous layer 80 and the seal layer 90 combined. The porous layer 80 may be in an arbitrary shape, but may have a shape that reflects the shape of a resist layer 70 to be described below in the manufacturing process. A void 72 is formed inside the porous layer 80. The void is appended with a reference numeral 72 for the convenience of description of the embodiment. The porous layer 80 has the void 72 on the inside, and the capacitor structure section 60 is further provided inside the void 72. The porous layer 80 may contain in its inner space a single capacitor structure section 60 or a plurality of capacitor structure sections 60. FIG. 1 and FIG. 11 are cross-sectional views of a liquid jet head 1000 in which a single region contained by the porous layer 80 includes one capacitor structure section 60. The porous layer 80 has fine through holes, and is capable of transferring gas through the holes. Also, the porous layer 80 may preferably have enough mechanical strength to sustain its shape by itself. The thickness of the porous layer 80 may be set without any particular limitation, but may preferably be between 0.2 μm and 2 μm. The material of the porous layer 80 may be any one of oxide, nitride and organic substance. Preferably, the material of the porous layer 80 may be aluminum oxide, or other material without any particular limitation, as long as the material becomes porous and has a sufficient mechanical strength when formed into a film. For example, the porous layer 80 may be composed of aluminum oxide, and formed to a thickness of 1.2 μm.

The seal layer 90 is formed on the porous layer 80, as shown in FIG. 1 and FIG. 11. FIG. 1 illustrates the porous layer 80 and the seal layer 90 combined. The seal layer 90 has a function to seal the through holes of the porous layer 80 to maintain air-tightness of the void 72 on its inside, and a function to reinforce the mechanical strength of the porous layer 80. In accordance with the present embodiment, the seal layer is provided in a pressure lower than the atmospheric pressure, such that the void 72 has a negative pressure state when the liquid jet head 1000 is placed in the atmosphere. The thickness of the seal layer 90 is not particularly limited as long as its function is achieved, and may preferably be 0.1 μm to 1.5 μm. The seal layer 90 may be composed of any dense material having airtightness. For example, silicon nitride, silicon oxide and aluminum oxide are suitable. For any of the materials used, its film forming condition is set such that the seal layer 90 becomes dense to have enough airtightness. For example, the seal layer 90 may be formed with silicon nitride to a thickness of 1 μm.

1.2. Method for Manufacturing Liquid Jet Head

FIGS. 2 through 11 are cross-sectional views schematically showing a method for manufacturing the liquid jet head 1000 in accordance with an embodiment of the invention. The structure illustrated corresponds to a portion that is deformable by piezoelectric operation of the main portion of the liquid jet head 1000, in other words, mainly to a piezoelectric actuator section 100 (see FIG. 10 and FIG. 11). It is noted that, for the convenience of description, a simplified example is shown here, and the structure in accordance with the present embodiment is not limited to the structure shown herein.

(a) A process of successively forming, above a substrate 10, an elastic plate 20, a lower electrode layer 30*a*, a piezoelectric layer 40*a* and an upper electrode layer 50*a* is described below.

Figure 2:
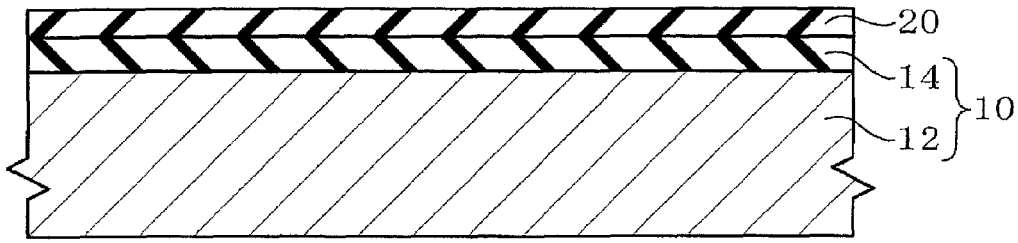
FIG. 2 is a schematic cross-sectional view showing a main part of the liquid jet head 1000 in a step of manufacturing the liquid jet head 1000 in accordance with the first embodiment.

As shown in FIG. 2, first, a substrate 10 is prepared, and an elastic plate 20 is formed. The substrate 10 may be formed from a silicon substrate. When the substrate 10 is formed from a silicon layer 12 and an oxide layer formed thereon, a thermal oxidation treatment may be conducted. Alternatively, when an oxide layer 14 is independently provided on the substrate 10, the oxide layer 14 may be formed by a known method, such as, a vapor deposition method, a sputter method or the like. Then as shown in FIG. 2, an elastic plate 20 is formed. The elastic plate 20 may be formed by a known method, such as, a sputter method, a vacuum vapor deposition method, or a chemical vapor deposition method (hereafter referred to as a CVD method).

Figure 3:
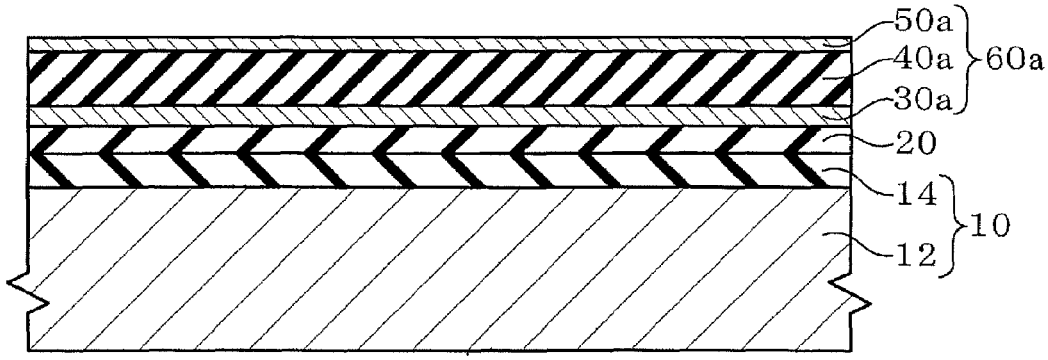
FIG. 3 is a schematic cross-sectional view showing the main part of the liquid jet head 1000 in a step of manufacturing the liquid jet head 1000 in accordance with the first embodiment.

Next, as shown in FIG. 3, a lower electrode layer 30*a*, a piezoelectric layer 40*a* and an upper electrode layer 50*a* are successively formed in this order on the elastic plate 20. Accordingly, the piezoelectric layer 40*a* is formed between the lower electrode layer 30*a* and the upper electrode layer 50*a*, thereby forming a capacitor type structure. A portion having such a structure is called a capacitor structure section 60*a*, and a new reference number is appended thereto.

The lower electrode layer 30*a* may be formed by a known method, such as, a sputter method, a vacuum vapor deposition method or a CVD method.

The piezoelectric layer 40*a* may be formed by a known method, such as, for example, a sol-gel method, an organic metal thermal coating decomposition method (MOD method) or a sputter method according to its material. In the present embodiment, a sol-gel method is used to form the piezoelectric layer 40*a*.

The upper electrode layer 50*a* may be formed by a known method, such as, a sputter method, a vacuum deposition method or a CVD method.

(b) A process of forming a capacitor structure section 60 by patterning the lower electrode layer 30*a*, the piezoelectric layer 40*a* and the upper electrode layer 50*a* is described below.

Figure 4:
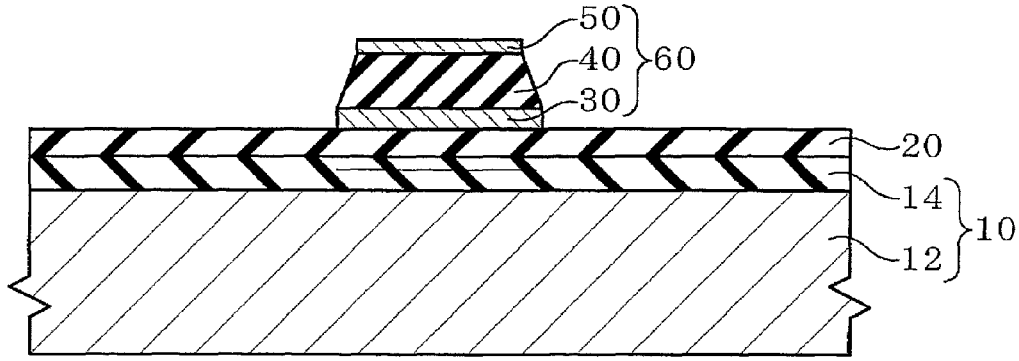
FIG. 4 is a schematic cross-sectional view showing the main part of the liquid jet head 1000 in a step of manufacturing the liquid jet head 1000 in accordance with the first embodiment.

As shown in FIG. 4, the capacitor structure section 60*a* formed in the process (a) is patterned, thereby forming a capacitor structure section 60. The patterning may be conducted by a known photolithography technique using a resist and etching.

(c) A process of forming a resist layer 70 that covers the capacitor structure section 60 is described below.

Figure 5:
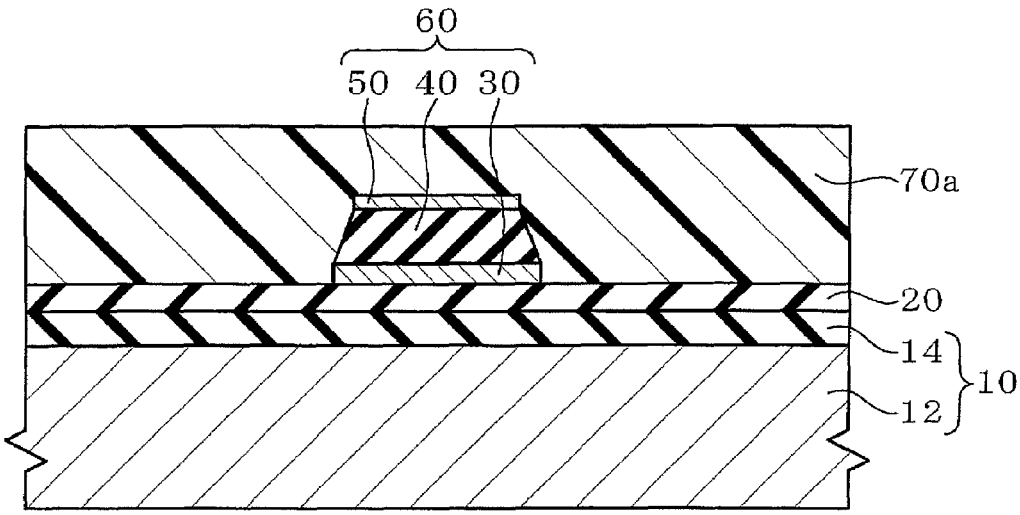
FIG. 5 is a schematic cross-sectional view showing the main part of the liquid jet head 1000 in a step of manufacturing the liquid jet head 1000 in accordance with the first embodiment.
Figure 6:
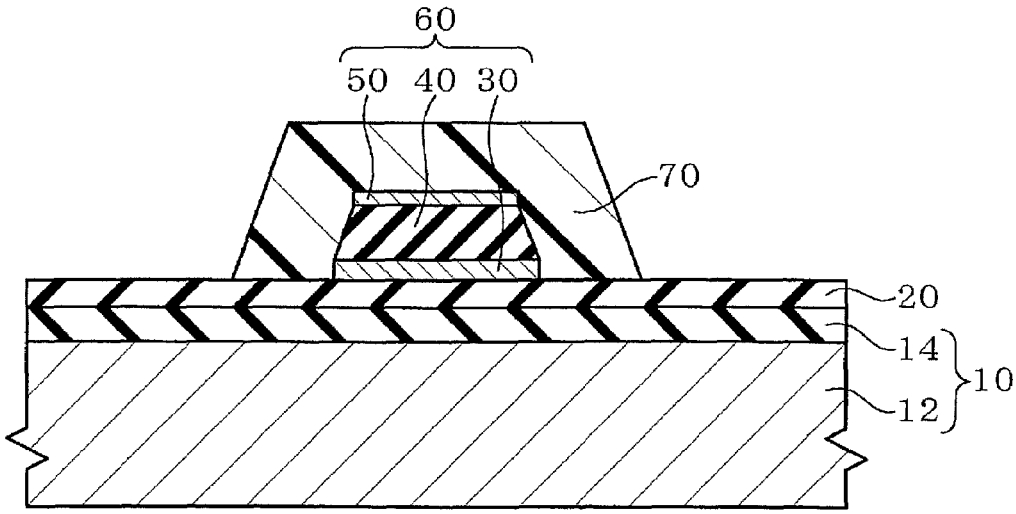
FIG. 6 is a schematic cross-sectional view showing the main part of the liquid jet head 1000 in a step of manufacturing the liquid jet head 1000 in accordance with the first embodiment.

First, as shown in FIG. 5, a resist layer 70*a* that covers the capacitor structure section 60 is provided. The resist layer 70*a* is provided to add a shape to a porous layer 80 to be described below. Accordingly, the resist layer 70*a* needs to be provided to totally embed the capacitor structure section 60 so that the porous layer 80 would not contact the capacitor structure section 60. As the material of the resist layer 70*a*, an ordinary organic type resist material may be used. Next, the resist layer 70*a* is patterned by a known photolithography technique, as shown in FIG. 6, thereby forming a resist layer 70. In FIG. 6, the patterned resist layer 70 is illustrated as embedding a single capacitor structure section 60. However, a plurality of capacitor structure sections 60 may be embedded in a single patterned resist layer 70.

(d) A process of forming a porous layer 80 that covers the resist layer 70 is described below.

Figure 7:
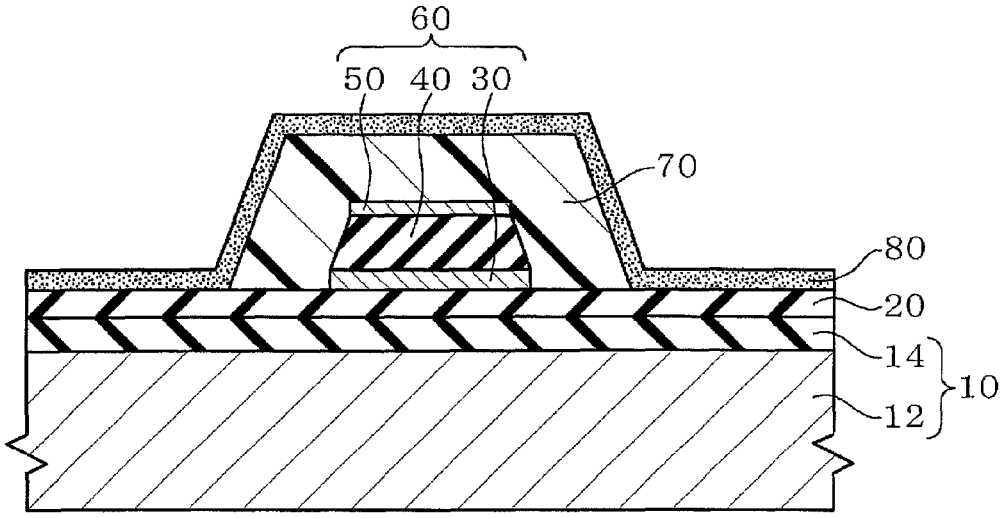
FIG. 7 is a schematic cross-sectional view showing the main part of the liquid jet head 1000 in a step of manufacturing the liquid jet head 1000 in accordance with the first embodiment.

As shown in FIG. 7, the porous layer 80 is formed along the resist layer 70. As the method for forming the porous layer 80, when aluminum oxide is selected as the material of the porous layer 80, a CVD method or a sputter method may be used. In the case of a CVD method, trimethyl-aluminum may be used as the material; and a series of operations including blowing the material, introducing ozone and conducting thermal oxidation at 400° C. or lower may be repeated to form a desired layer. The condition to form the porous layer 80 may be changed according to the material selected. For example, aluminum oxide may be selected as the material, a CVD method may be conducted, and the temperature for thermal oxidation may be set at 200° C.

(e) A process of introducing gas through holes of the porous layer 70 thereby removing the resist layer 70 by an ashing method is described below.

Figure 8:
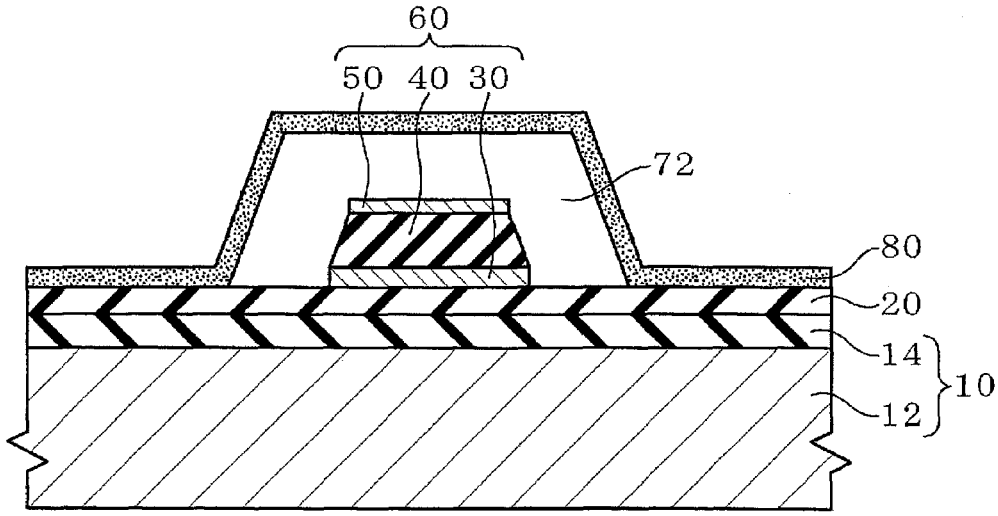
FIG. 8 is a schematic cross-sectional view showing the main part of the liquid jet head 1000 in a step of manufacturing the liquid jet head 1000 in accordance with the first embodiment.

Succeeding the process (d), the resist layer 70 is removed. FIG. 8 shows the result in which the resist layer 70 is removed. The removal of the resist layer 70 may be conducted, for example, by ashing with oxygen, in other words, by burning. After the porous layer 80 is formed, the removal of the resist layer 70 may be conducted in succession through introducing oxygen gas and generating oxygen plasma in a chamber. In this instance, the oxygen plasma passes through the through holes of the porous layer 80, and reacts with the material of the resist layer 70 inside the porous layer 80. The resultant combustion gas passes through the through holes of the porous layer 80, and is removed outside. By this mechanism, while the porous layer 80 maintains its shape, the resist layer 70 inside is removed. Also, beside the use of oxygen, any gas capable of ashing the resist layer 70 can be used to conduct the ashing process. Through this ashing process, the void 72 is formed inside the porous layer 80.

(f) A process of forming a seal layer 90 that covers the porous layer 80 is described below.

Figure 9:
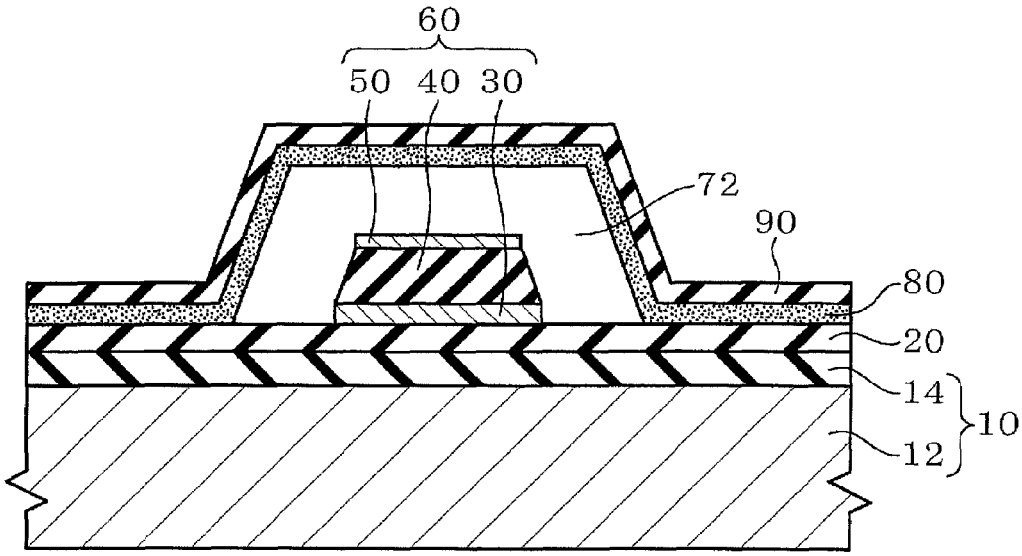
FIG. 9 is a schematic cross-sectional view showing the main part of the liquid jet head 1000 in a step of manufacturing the liquid jet head 1000 in accordance with the first embodiment.
Figure 10:
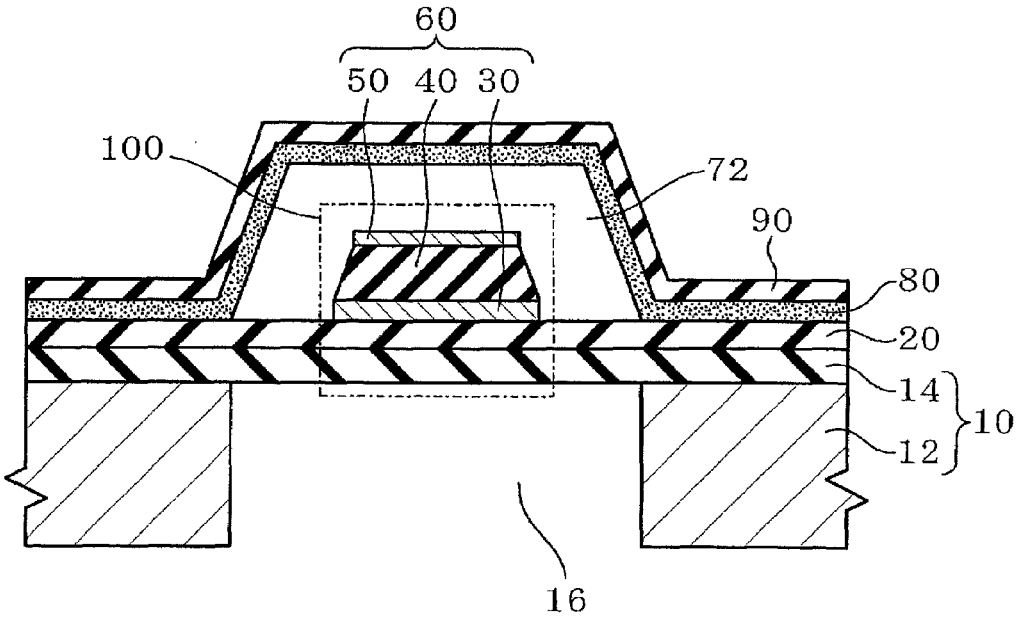
FIG. 10 is a schematic cross-sectional view showing the main part of the liquid jet head 1000 in a step of manufacturing the liquid jet head 1000 in accordance with the first embodiment.

Succeeding the process (e), as shown in FIG. 9, the seal layer 90 is formed on the porous layer 80. The seal layer 90 may be formed by a known method, such as, a sputter method, a CVD method or the like.

(g) A process of forming a pressure generation chamber 16 in the substrate 10 is described.

As shown in FIG. 11, a pressure generation chamber 16 is formed in the substrate 10. The pressure generation chamber 16 may be formed through forming a concave hole by applying a known anisotripic etching technique to the lower surface of the substrate 10, and then bonding a nozzle plate 18 to the bottom of the substrate 10. The nozzle plate 18 may be formed from a stainless steel plate having aperture sections 18*a*.

1.3. Action and Effect 1.3.1. Liquid Jet Head

As the liquid jet head 1000 in accordance with the present embodiment has the structure described above, deterioration of the piezoelectric layer 40 of the capacitor structure section 60, which is a major factor of deterioration of the liquid jet head 1000, can be suppressed. In other words, the capacitor structure section 60 in its entirety is provided inside the void 72 sealed by the porous layer 80 and the seal layer 90, and therefore does not contact the atmosphere, such that deterioration of the piezoelectric layer 40 can be suppressed. In accordance with the present embodiment, in addition to the above, the void 72 is in a reduced pressure state, and therefore there is little substance that may influence the piezoelectric layer 40, such that the effect of suppressing deterioration of the liquid jet head 1000 is greater.

1.3.2. Method for Manufacturing Liquid Jet Head

According to the manufacturing method in accordance with the present embodiment, deterioration of the capacitor structure section 60, which is a major factor of deterioration of the liquid jet head 1000, can be avoided. In other words, according to the manufacturing method in accordance with the present embodiment, the structure that covers the capacitor structure section 60 can be formed continuously in a vacuum apparatus, such that the atmosphere and the capacitor structure section 60 do not contact each other during this process. Accordingly, in the manufacturing method in accordance with the present embodiment, there is no influence of water molecule on the piezoelectric layer 40 of the capacitor structure section 60, and deterioration of the performance of the liquid jet head can be suppressed. Furthermore, according to the manufacturing method in accordance with the present embodiment, the void 72 is formed in a vacuum apparatus, such that the void 72 can be placed in a reduced pressure state without having to apply other special processes.

2. Second Embodiment

Figure 12:
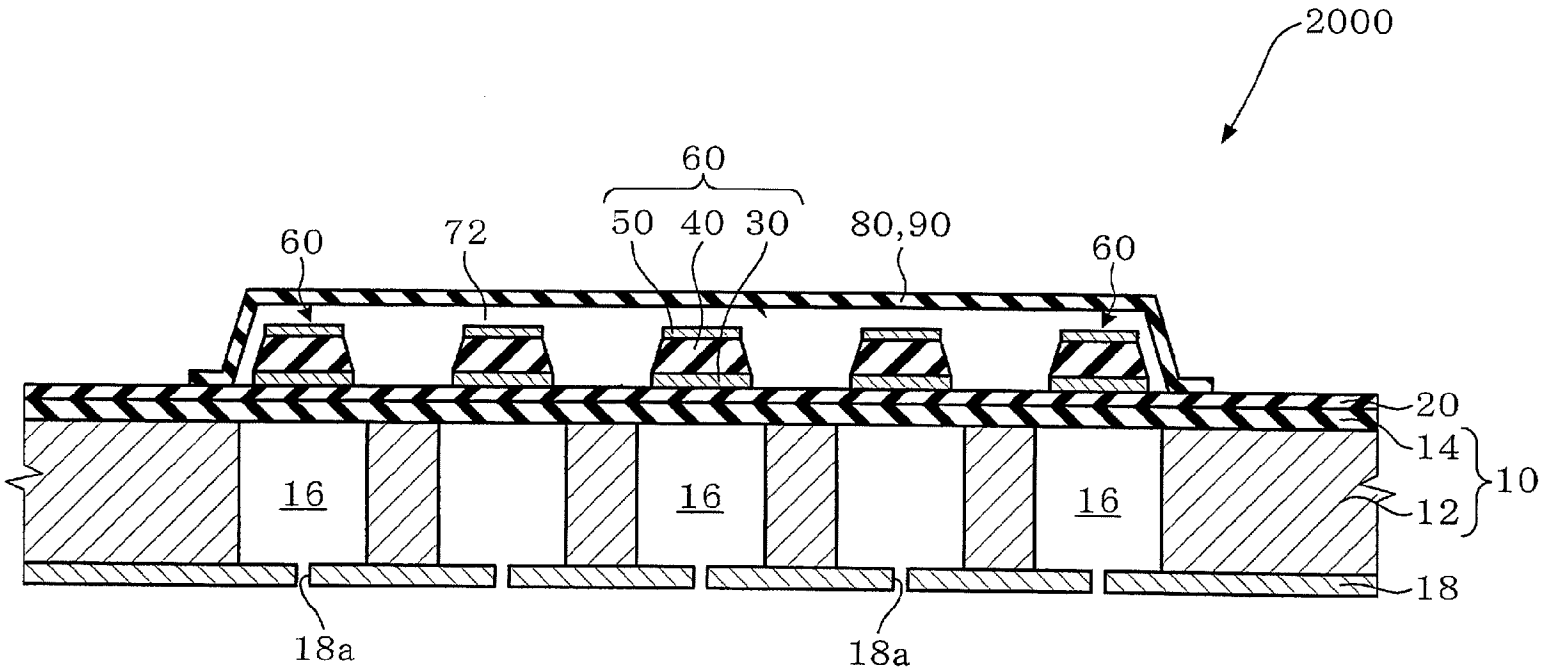
FIG. 12 is a schematic cross-sectional view of a liquid jet head 2000 in accordance with a second embodiment of the invention.

A liquid jet head 2000 in accordance with a second embodiment is described with reference to FIG. 12. FIG. 12 is a schematic cross-sectional view of an example in which a plurality of (five in the illustrated example) capacitor structure sections 100 are provided in a single void 72.

2.1. Liquid Jet Head 2000

The present embodiment is different from the first embodiment in that a plurality of adjoining capacitor structure sections 60 are provided in a single void 72, but is substantially the same as the first embodiment except the aforementioned difference. Members that are substantially the same as the members of the liquid jet head 1000 of the first embodiment are appended with the same reference numbers, and their detailed description is omitted.

Concretely, the liquid jet head 2000 in accordance with the second embodiment includes a substrate 10, pressure generation chambers 16 provided in the substrate 10, an elastic plate 20 provided above the substrate 10, capacitor structure sections 60 provided above the elastic plate 20, each of the capacitor structure sections 60 having a lower electrode layer 30, a piezoelectric layer 40 and an upper electrode layer 50, a porous layer 80 provided above the elastic plate 20 without contacting the capacitor structure sections 60, and a seal layer 90 provided on the porous layer 80. A void section 72 is formed between the capacitor structure sections 60 and the porous layer 80. Also, the capacitor structure sections 60, arranged adjacent to one another in plurality, are provided in a single void section 72.

2.2. Method for Manufacturing Liquid Jet Head

A method for manufacturing the liquid jet head 2000 in accordance with the second embodiment is described. The manufacturing method in accordance with the second embodiment is different from the first embodiment in that a plurality of adjoining capacitor structure sections 60 are provided in a single void 72, but substantially the same as the first embodiment except the aforementioned difference.

Concretely, the difference lies in the process (c) of forming the resist layer 70 that covers the capacitor structure sections 60 described above in the section 1.2. in the first embodiment concerning the method for manufacturing the liquid jet head. In the second embodiment, a resist layer 70*a* that covers a plurality of capacitor structure sections 60 is provided, and the resist layer 70*a* is patterned by a known photolithography technique, thereby forming a resist layer 70. In this instance, the plurality of capacitor structure sections 60 are embedded in the single patterned resist layer 70.

2.3. Action and Effect 2.3.1. Liquid Jet Head

As the liquid jet head 2000 in accordance with the present embodiment has the structure described above, deterioration of the piezoelectric layer 40 of the capacitor structure sections 60, which is a major factor of deterioration of the liquid jet head 2000, can be suppressed, like the first embodiment. In other words, the plurality of capacitor structure sections 60 in their entirety are provided inside the void 72 sealed by the porous layer 80 and the seal layer 90, and therefore do not contact the atmosphere, such that deterioration of the piezoelectric layers 40 can be suppressed. In accordance with the present embodiment, in addition to the above, the void 72 is in a reduced pressure state, and therefore there is little substance that may influence the piezoelectric layers 40, such that the effect of suppressing deterioration of the liquid jet head 2000 is greater.

2.3.2. Method for Manufacturing Liquid Jet Head

According to the manufacturing method in accordance with the present embodiment, like the first embodiment, deterioration of the capacitor structure sections 60, which is a major factor of deterioration of the liquid jet head 2000, can be avoided. In other words, according to the manufacturing method in accordance with the present embodiment, the structure that covers the plurality of capacitor structure sections 60 can be formed continuously in a vacuum apparatus, such that the atmosphere and the capacitor structure sections 60 do not contact each other during this process. Accordingly, in the manufacturing method in accordance with the present embodiment, there is no influence of water molecule on the piezoelectric layers 40 of the capacitor structure sections 60, and deterioration of the performance of the liquid jet head can be suppressed. Furthermore, according to the manufacturing method in accordance with the present embodiment, the void 72 is formed in a vacuum apparatus, such that the void 72 can be placed in a reduced pressure state without having to apply other special processes.

3. Third Embodiment 3.1. Liquid Jet Head

Figure 13:
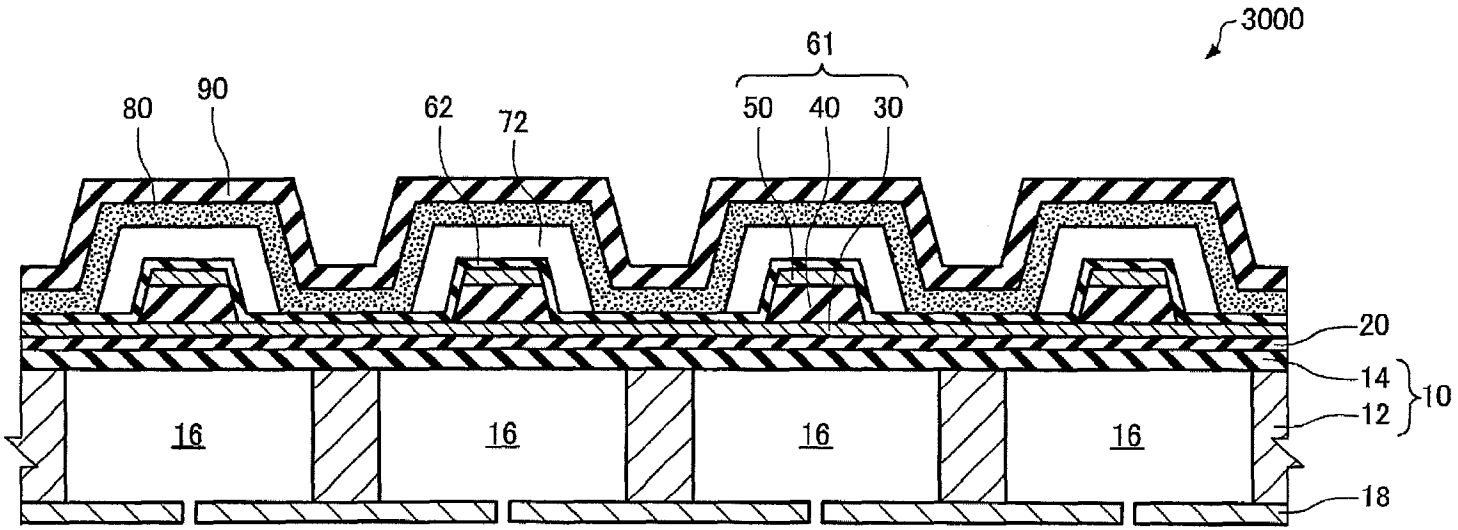
FIG. 13 is a schematic cross-sectional view of a liquid jet head 3000 in accordance with a third embodiment of the invention.
Figure 22:
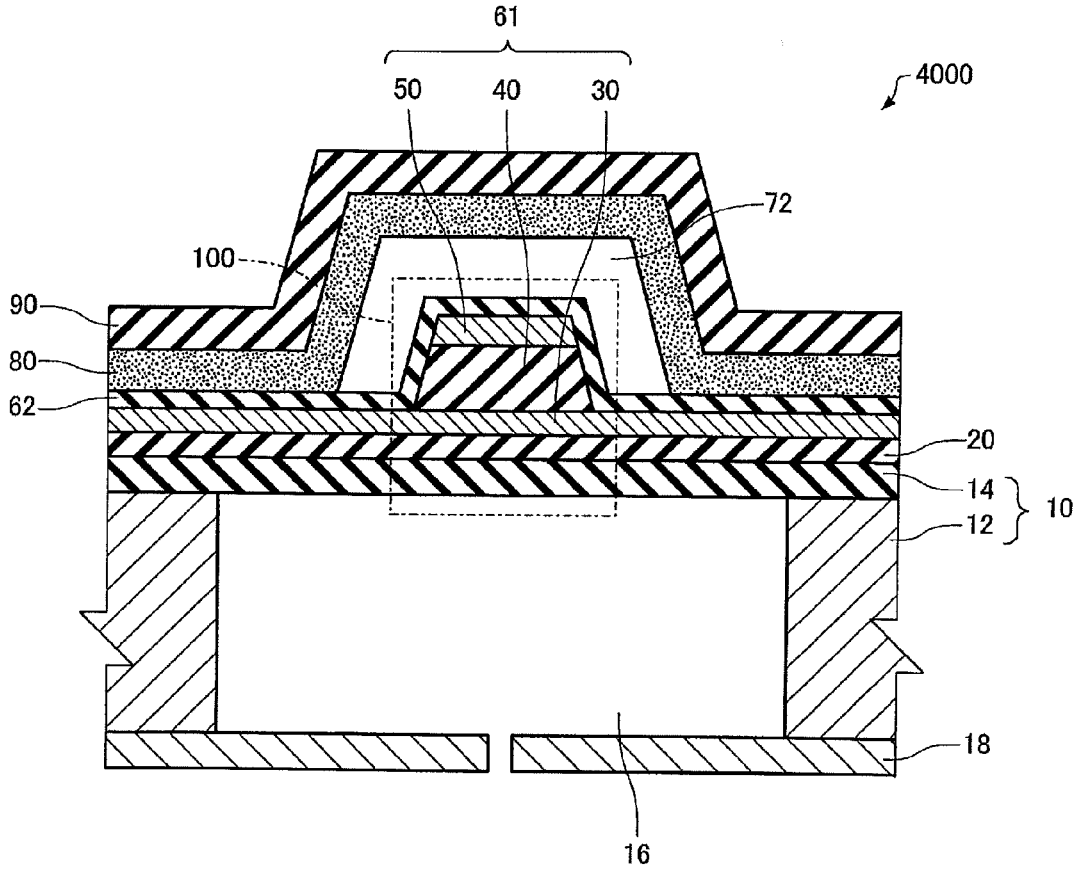
FIG. 22 is a schematic cross-sectional view showing a main part of the liquid jet head 3000 in accordance with the third embodiment.

FIG. 13 is a schematic cross-sectional view of a liquid jet head 3000 in accordance with a third embodiment. FIG. 22 is a schematic cross-sectional view showing a main part in enlargement of the liquid jet head 3000. The liquid jet head 3000 in accordance with the present embodiment is different from the liquid jet head 1000 in accordance with the first embodiment in that it further includes a protection layer 62. More specifically, the liquid jet head 3000 in accordance with the third embodiment includes a substrate 10, pressure generation chambers 16 provided in the substrate 10, an elastic plate 20 provided above the substrate 10, capacitor structure sections 61 provided above the elastic plate 20, each of the capacitor structure sections 61 having a lower electrode layer 30, a piezoelectric layer 40 and an upper electrode layer 50, a protection layer 62 formed on the top surface and side surface of each of the capacitor structure sections 61, a porous layer 80 provided above the elastic plate 20 without contacting the capacitor structure sections 61, and a seal layer 90 provided on the porous layer 80. A void section 72 is formed between the capacitor structure sections 61 and the porous layer 80.

Members that are substantially the same as the members of the liquid jet head 1000 of the first embodiment are appended with the same reference numbers, and their detailed description is omitted.

It is noted that, in FIG. 13 and FIG. 22, the lower electrode layer 30 is continuously formed across the plurality of capacitor structure sections 61. Instead, the lower electrode 30 may be separated from one another for the corresponding capacitor structure sections, respectively, like the shape of the piezoelectric layer 40 and the upper electrode layer 50 of the liquid jet head 1000 described above.

The protection layer 62 is formed in a manner to cover the top surface and the side surface of each of the capacitor structure sections 61, as shown in FIG. 13 and FIG. 22. It is noted that the protection layer 62 is not limited to the shape illustrated in FIG. 13, but may be acceptable if it covers at least the side surface of the capacitor structure section 61. The material of the protection layer 62 may be oxide, nitride or organic substance, and may be, for example, aluminum oxide, silicon oxide, silicon nitride or the like. The thickness of the protection layer 62 may be sufficiently small such that it does not adversely affect the operation of the actuator section 100, and may preferably be thinner than a seal layer 90 or a porous layer 80 to be described below, and may more preferably be 0.1 μm or smaller.

By providing such a protection layer 62, the capacitor structure section 61 is prevented from being short-circuited upon application of an electric field due to adhesion of water droplets or the like to the side surface of the capacitor structure section 61, without adversely affecting the operation of the actuator section 100.

Further, as the protection layer 62 has the shape that entirely covers the side surface and the upper surface of the capacitor structure section 61, the capacitor structure section 61 can be more securely protected.

The porous layer 80 is provided above the capacitor structure section 61, as shown in FIG. 13 and FIG. 22. A void section 72 is formed inside the porous layer 80. The porous layer 80 has the void section 72 on the inside, and the protection layer 62 and the capacitor structure section 61 are provided inside the void section 72. The porous layer 80 may contain in its inner space a single capacitor structure section 61 as shown in FIG. 22, or a plurality of capacitor structure sections 61. The porous layer 80 has fine through holes, and is capable of transferring gas through the holes. Also, the porous layer 80 may preferably have enough mechanical strength to sustain its shape by itself. The thickness of the porous layer 80 may be set without any particular limitation, but may preferably be between 0.2 μm and 2 μm. The material of the porous layer 80 may be any one of oxide, nitride and organic substance. Preferably, the material of the porous layer 80 may be aluminum oxide. For example, the porous layer 80 may be composed of aluminum oxide, and formed to a thickness of 1.2 μm.

The seal layer 90 is formed on the porous layer 80, as shown in FIG. 13 and FIG. 22. The seal layer 90 has a function to seal the through holes of the porous layer 80 to maintain air-tightness of the void section 72 on its inside, and a function to reinforce the mechanical strength of the porous layer 80. In accordance with the present embodiment, the seal layer is provided in a pressure lower than the atmospheric pressure, such that the void section 72 has a negative pressure state when the liquid jet head 3000 is placed in the atmosphere. The thickness of the seal layer 90 is not particularly limited as long as its function is achieved, and may preferably be 0.1 μm to 1.5 μm. The seal layer 90 may be composed of any dense material having airtightness. For example, silicon nitride, silicon oxide and aluminum oxide are suitable. For any of the materials used, its film forming condition is set such that the seal layer 90 becomes dense to have enough airtightness. For example, the seal layer 90 may be formed with silicon nitride to a thickness of 1 μm.

As the liquid jet head 3000 in accordance with the present embodiment has the structure described above, deterioration of the piezoelectric layer 40 of the capacitor structure section 61, which is a major factor of deterioration of the liquid jet head 3000, can be suppressed. In other words, the capacitor structure section 61 in its entirety is provided inside the void section 72 sealed by the porous layer 80 and the seal layer 90, and therefore does not contact the atmosphere, such that deterioration of the piezoelectric layer 40 can be suppressed. In accordance with the present embodiment, in addition to the above, the void section 72 is in a reduced pressure state, and therefore there is little substance that may influence the piezoelectric layer 40, such that the effect of suppressing deterioration of the liquid jet head 3000 is greater.

Also, in the liquid jet head 3000 in accordance with the present embodiment, the protection layer 62 that is located below the void section 72 and adheres to the capacitor structure section 61 is provided, such that the capacitor structure section 61 can be more securely prevented from contacting the atmosphere, in addition to the effect described above. Furthermore, the protection layer 62 is formed to be sufficiently thin, and therefore does not adversely affect the operation of the actuator section 100.

3.2. Method for Manufacturing Liquid Jet Head

FIGS. 14 through 21 are cross-sectional views schematically showing a method for manufacturing the liquid jet head 3000 in accordance with an embodiment of the invention. The structure illustrated corresponds to a portion that is deformable by piezoelectric operation of the main portion of the liquid jet head 3000, in other words, mainly to a piezoelectric actuator section 100 (see FIG. 21 and FIG. 22). It is noted that, for the convenience of description, a simplified example is shown, and the structure in accordance with the present embodiment is not limited to the structure shown herein.

Figure 14:
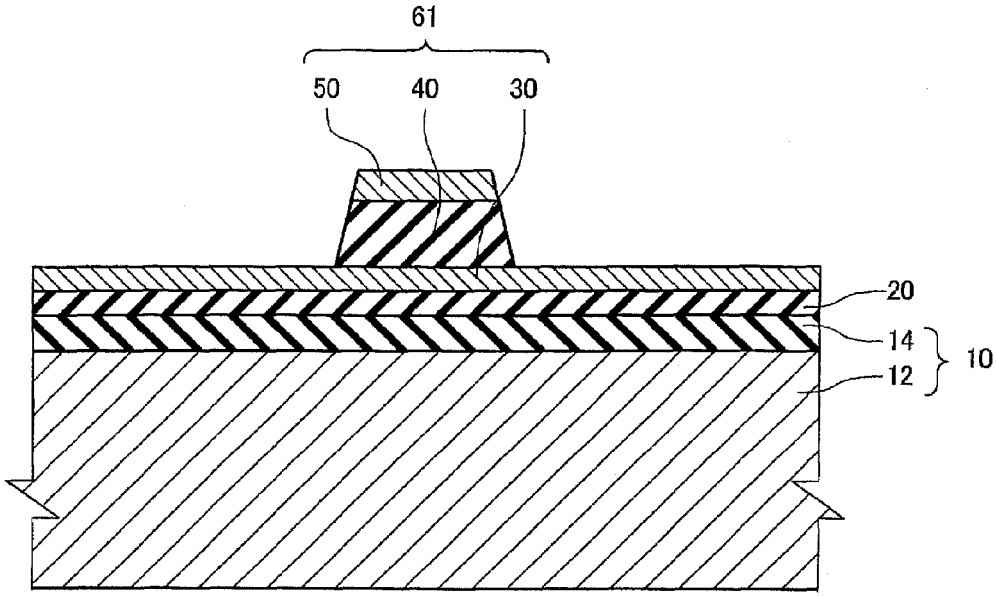
FIG. 14 is a schematic cross-sectional view showing a step of manufacturing the liquid jet head 3000 in accordance with the third embodiment.

(1) An elastic plate 20 is formed above a substrate 10. Then, a lower electrode layer 30*a*, a piezoelectric layer 40*a* and an upper electrode layer 50*a* are sequentially formed on the elastic plate 20. Then, the piezoelectric layer 40*a* and the upper electrode layer 50*a* are patterned, thereby forming a capacitor structure section 61, as shown in FIG. 14. The patterning may be conducted by a known lithography technique using a resist and etching.

Figure 15:
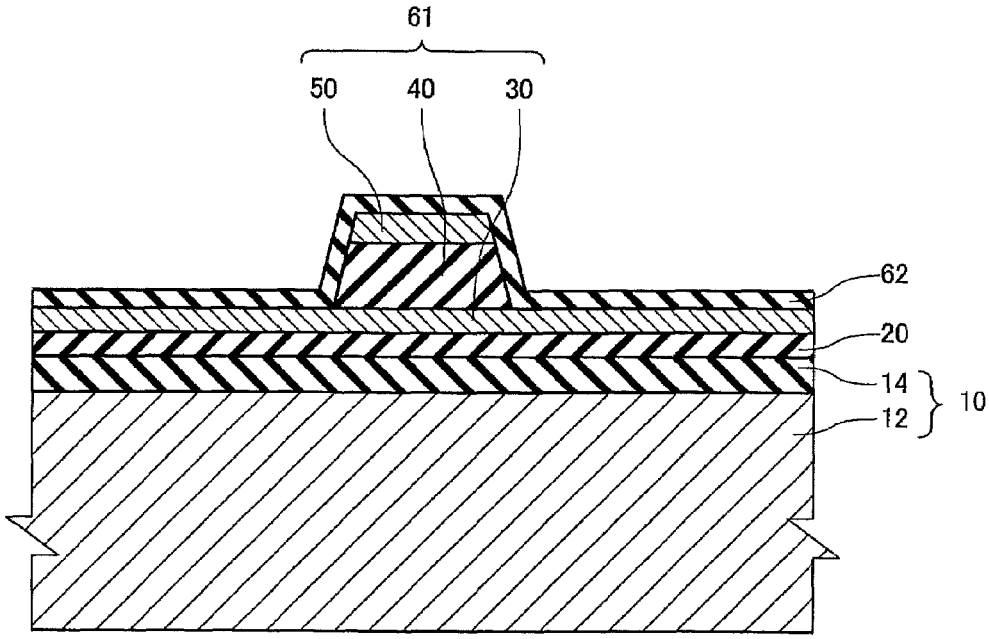
FIG. 15 is a schematic cross-sectional view showing a step of manufacturing the liquid jet head 3000 in accordance with the third embodiment.

(2) Next, as shown in FIG. 15, a protection layer 62 is formed on the top surface and the side surface of the capacitor structure section 61. The protection layer 62 may be formed by a known sputter method or CVD method. It is noted that, after forming the layer, the protection layer 62 may be patterned if necessary (not shown). The patterning may be conducted by, for example, the known photolithography technique described above.

(3) Then, a resistance layer 70 that covers the capacitor structure section 61 and the protection layer 62 is formed.

Figure 16:
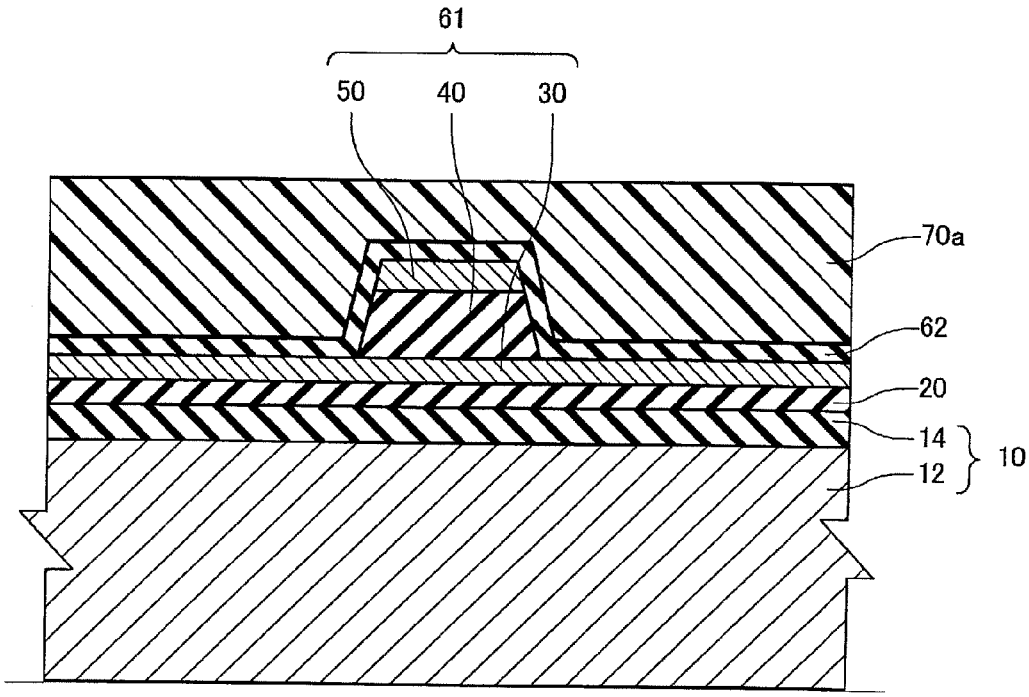
FIG. 16 is a schematic cross-sectional view showing a step of manufacturing the liquid jet head 3000 in accordance with the third embodiment.

First, as shown in FIG. 16, a resist layer 70*a* that covers the capacitor structure section 61 and the protection layer 62 is provided. The resist layer 70*a* is provided to add a shape to a porous layer 80 to be described below. The resist layer 70*a* needs to be provided above at least the upper electrode layer 50 and the piezoelectric layer 40 of the capacitor structure section 61. As the material of the resist layer 70*a*, an ordinary organic system resist material may be used.

Figure 17:
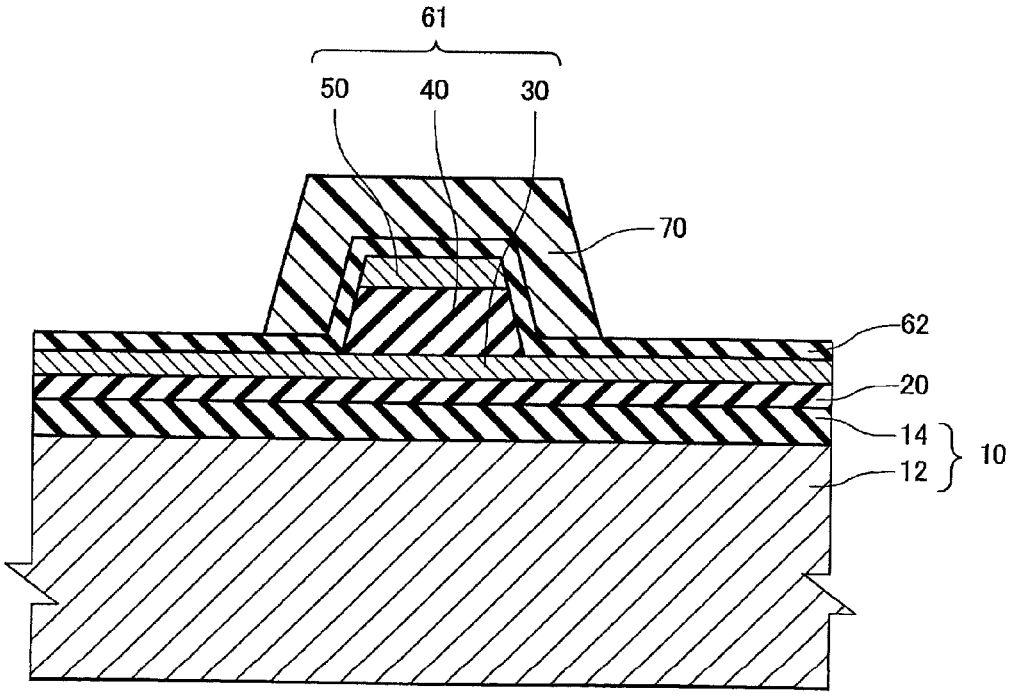
FIG. 17 is a schematic cross-sectional view showing a step of manufacturing the liquid jet head 3000 in accordance with the third embodiment.

Next, the resist layer 70*a* is patterned by a known photolithography technique, as shown in FIG. 17, thereby forming a resist layer 70. In FIG. 16, the patterned resist layer 70 is illustrated as embedding a single capacitor structure section 61. However, a plurality of capacitor structure sections 61 may be embedded in a single patterned resist layer 70.

Figure 18:
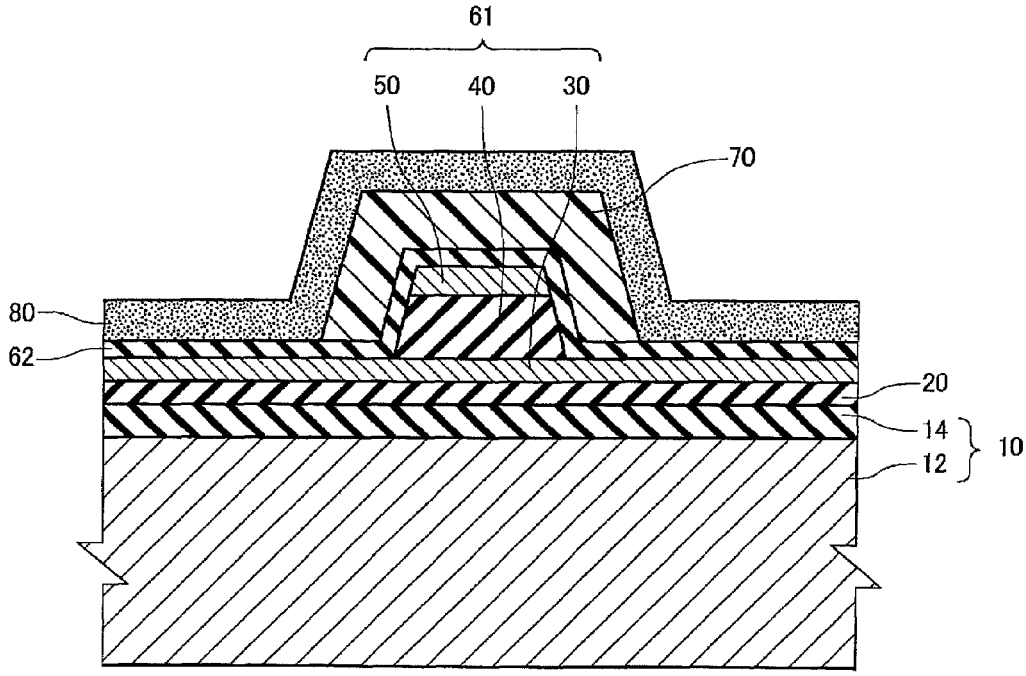
FIG. 18 is a schematic cross-sectional view showing a step of manufacturing the liquid jet head 3000 in accordance with the third embodiment.

(4) Next, as shown in FIG. 18, a porous layer 80 that covers the resist layer 70 is formed. The porous layer 80 is formed along the top surface and side surface of the resist layer 70. As the method for forming the porous layer 80, when aluminum oxide is selected as the material of the porous layer 80, a CVD method or a sputter method may be used. In the case of a CVD method, trimethyl-aluminum may be used as the material, and a series of operations including blowing the material, introducing ozone and conducting thermal oxidation at 400° C. or lower may be repeated to form a desired layer. The condition to form the porous layer 80 may be changed according to the material selected. For example, aluminum oxide may be selected as the material, a CVD method may be conducted, and thermal oxidation may be conducted at a temperature of 200° C.

Figure 19:
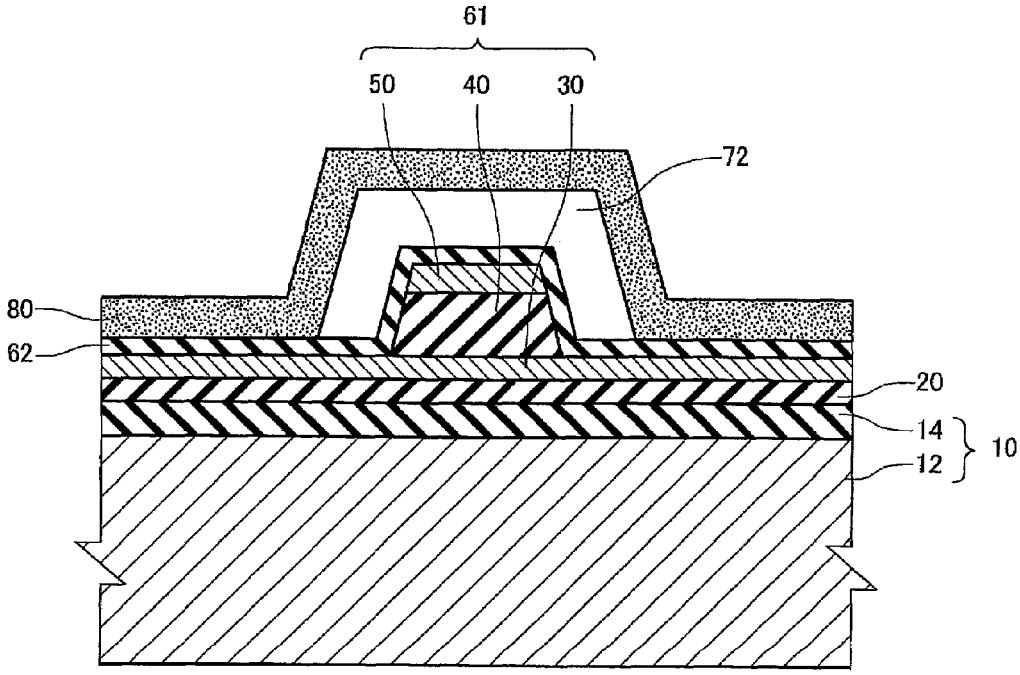
FIG. 19 is a schematic cross-sectional view showing a step of manufacturing the liquid jet head 3000 in accordance with the third embodiment.

(5) Then, the resist layer 70 is removed. FIG. 19 shows the result in which the resist layer 70 is removed. Concretely, the resist layer 70 is removed by ashing through introducing gas through the pores of the porous layer 70. The ashing may be conducted, for example, by ashing with oxygen, in other words, by burning. After the porous layer 80 is formed, the removal of the resist layer 70 may be conducted in succession in the chamber through introducing oxygen gas in the chamber and generating oxygen plasma therein. In this instance, the oxygen plasma passes through the through holes of the porous layer 80, and reacts with the material of the resist layer 70 inside the porous layer 80. The resultant combustion gas passes through the through holes of the porous layer 80, and is removed outside. By this mechanism, while the porous layer 80 maintains its shape, the resist layer 70 inside is removed. Also, beside the use of oxygen, any gas capable of ashing the resist layer 70 can be used to conduct the ashing process. Through this ashing process, the void section 72 is formed inside the porous layer 80.

Figure 20:
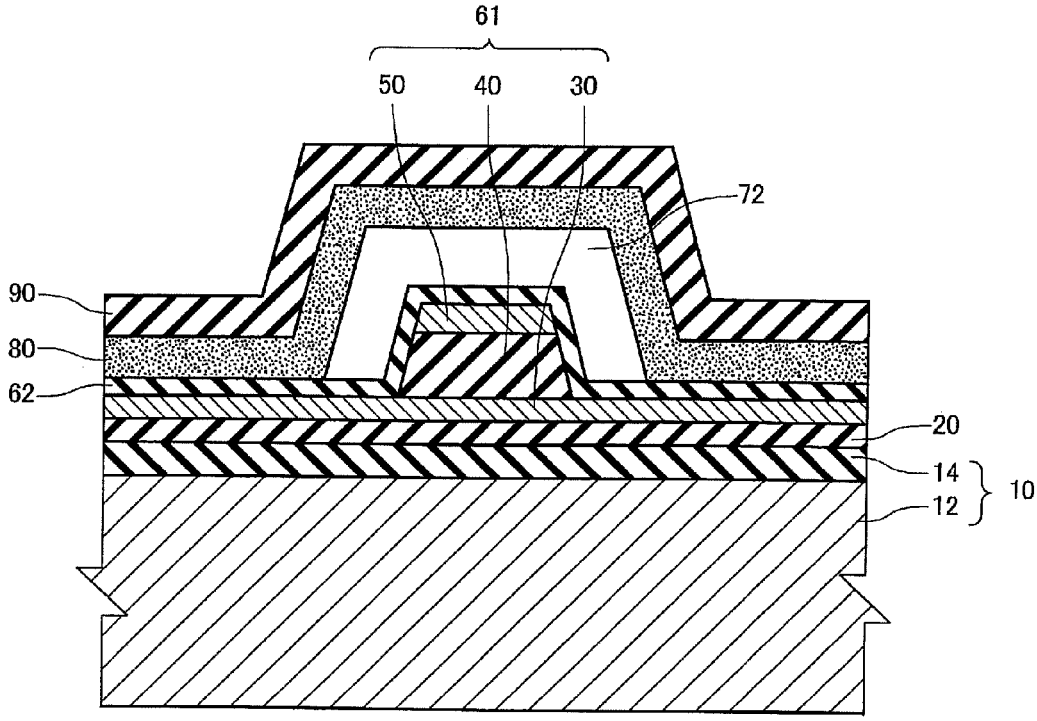
FIG. 20 is a schematic cross-sectional view showing a step of manufacturing the liquid jet head 3000 in accordance with the third embodiment.
Figure 21:
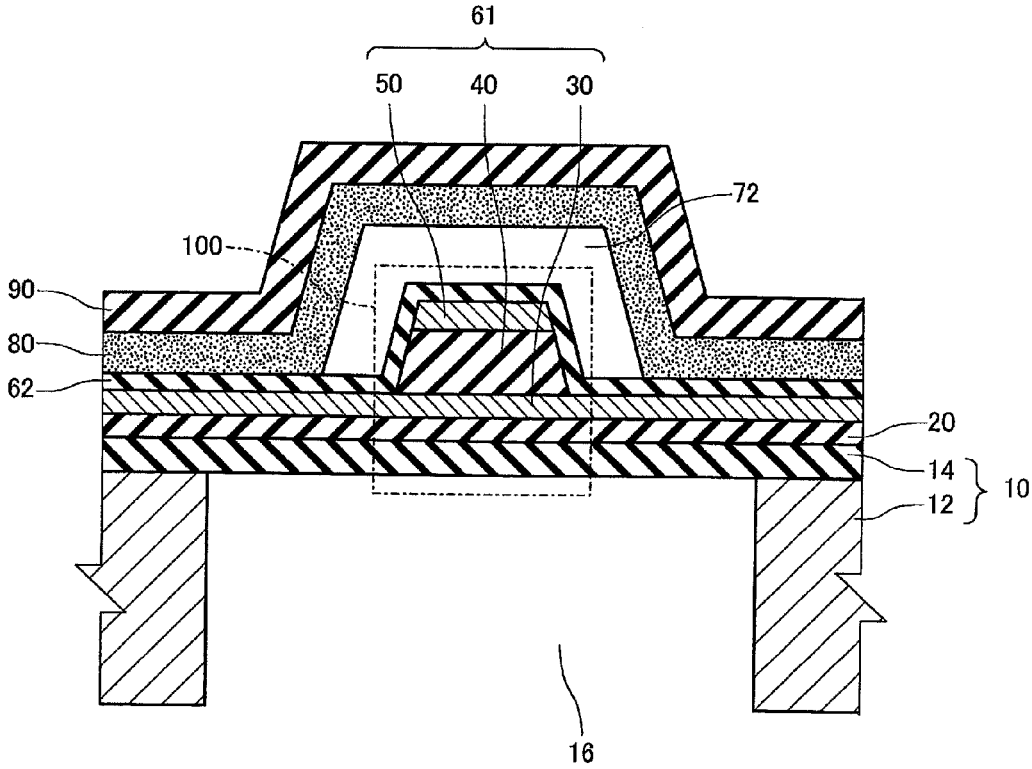
FIG. 21 is a schematic cross-sectional view showing a step of manufacturing the liquid jet head 3000 in accordance with the third embodiment.

(6) Next, as shown in FIG. 20, a seal layer 90 that covers the porous layer 80 is formed. The seal layer 90 is formed on the porous layer 80. The seal layer 90 may be formed by a known method, such as, a sputter method, a CVD method or the like.

(7) Next, a pressure generation chamber 16 is formed in the substrate 10. The pressure generation chamber 16 may be formed through forming a concave hole by applying a known anisotripic etching technique from the lower surface of the substrate 10 (see FIG. 21), and then bonding a nozzle plate 18 to the bottom of the substrate 10 (see FIG. 22). The nozzle plate 18 may be formed from a stainless steel plate having aperture sections 18*a*.

By the process described above, the liquid jet head 3000 can be manufactured. According to the method for manufacturing the liquid jet head 3000 in accordance with the present embodiment, deterioration of the capacitor structure section 61, which is a major factor of deterioration of the liquid jet head 3000, can be avoided. In other words, according to the manufacturing method in accordance with the present embodiment, the structure that covers the capacitor structure section 61 can be formed continuously in a vacuum apparatus, such that the atmosphere and the capacitor structure section 61 do not contact each other during this process.

Accordingly, in the manufacturing method in accordance with the present embodiment, there is no influence of water molecule on the piezoelectric layer 40 of the capacitor structure section 61, and deterioration of the performance of the liquid jet head can be suppressed. Furthermore, according to the manufacturing method in accordance with the present embodiment, the void section 72 is formed in a vacuum apparatus, such that the void section 72 can be placed in a reduced pressure state without having to apply other special processes.

3.3. MODIFIED EXAMPLE

Next, modified examples in accordance with a third embodiment are described below.

3.3.1. First Modified Example

Figure 23:
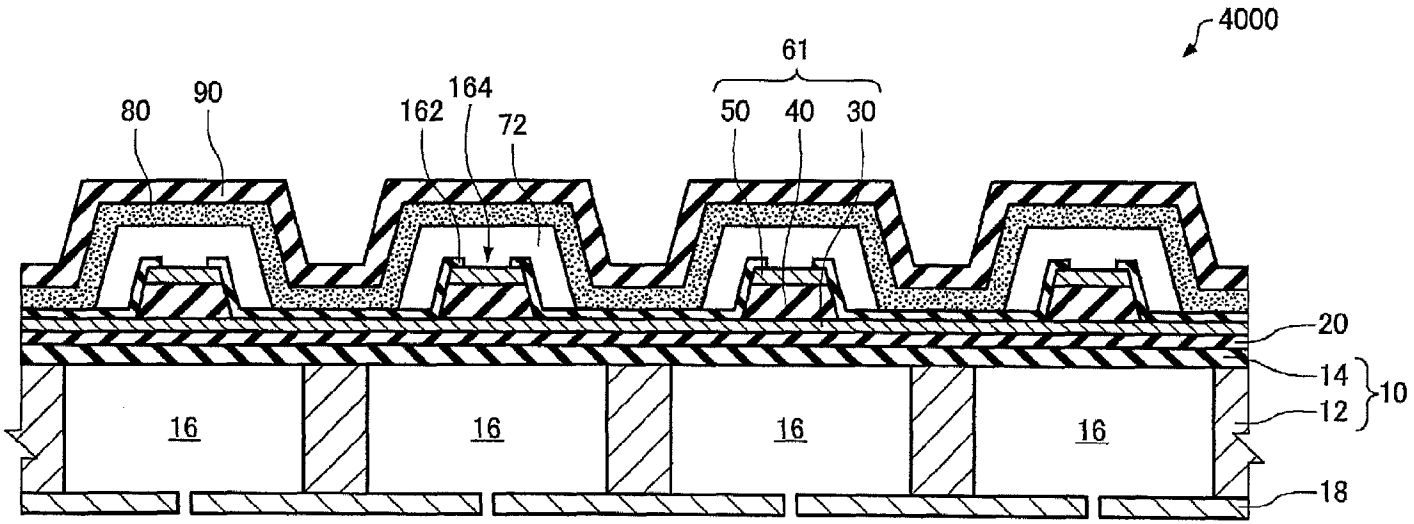
FIG. 23 is a schematic cross-sectional view showing a main part of a liquid jet head 4000 in accordance with a first modified example.

FIG. 23 is a schematic cross-sectional view of a liquid jet head 4000 in accordance with a first modified example, and corresponds to FIG. 13. The liquid jet head 4000 is different from the liquid jet head 3000 in accordance with the embodiment described above in that its protection layer 162 has an opening section 164 at the top surface of the upper electrode layer 50. It is desirable to form the opening section 164 only at the top surface of the upper electrode layer 50 in a wide area as much as possible. By providing such an opening section 164, the contact area of the protection layer 162 contacting the capacitor structure section 61 can be made smaller, and the influence on the operation of the actuator section 100 can be further reduced.

After forming a protection layer 162, the protection layer 162 may be patterned to obtain the opening sections 164. The patterning can be conducted by the known photolithography technique described above.

Other portions of the structure and method for manufacturing the liquid jet head 4000 in accordance with the first modified example are substantially the same as those of the structure and method for manufacturing the liquid jet head 3000 in accordance with the embodiment described above, and therefore their description is omitted.

3.3.2. Second Modified Example

Figure 24:
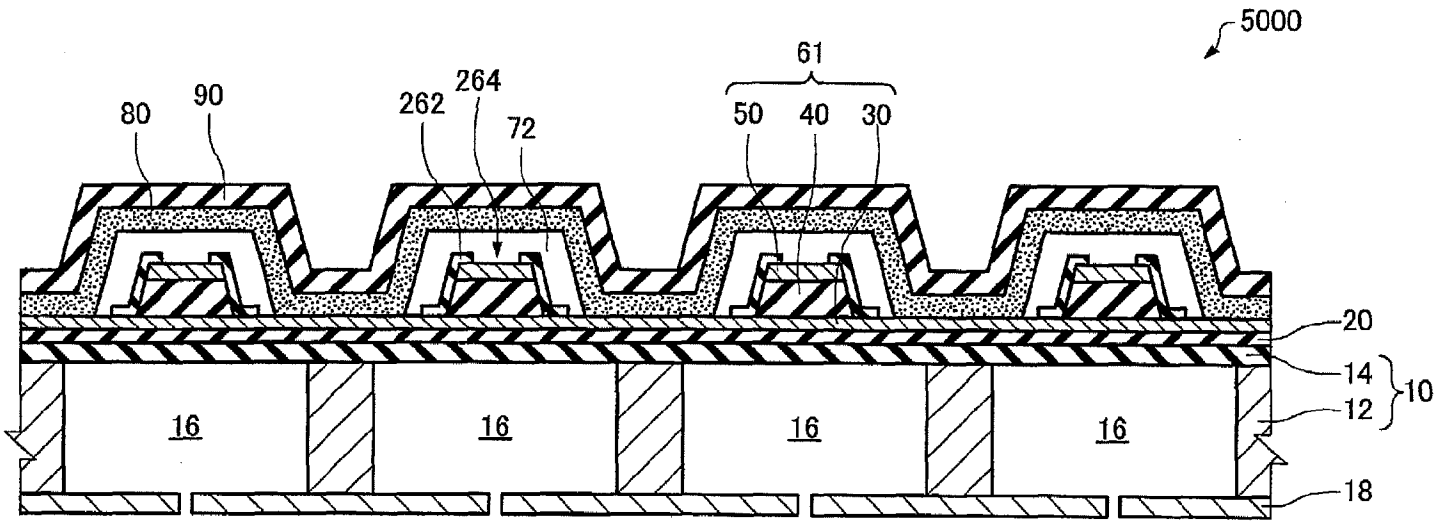
FIG. 24 is a schematic cross-sectional view showing a main part of a liquid jet head 5000 in accordance with a second modified example.

FIG. 24 is a schematic cross-sectional view of a liquid jet head 5000 in accordance with a second modified example, and corresponds to FIG. 13. The liquid jet head 5000 is different from the liquid jet head 3000 in accordance with the embodiment described above in that its protection layer 262 has an opening section 264 at the top surface of the upper electrode layer 50, and the protection layer 262 does not contact the porous layer 80.

It is desirable to form the opening section 264 only at the top surface of the upper electrode layer 50 in a wide area as much as possible. By providing such an opening section 264, the contact area of the protection layer 262 contacting the capacitor structure section 61 can be made smaller, and the influence on the operation of the actuator section 100 can be further reduced.

Also, the protection layer 262 does not contact the porous layer 80 or the seal layer 90. In other words, the protection layer 262 is completely covered by the void section 72. As the protection layer 262 is not in contact with the porous layer 80 or the seal layer 90, movements thereof are not restricted by these layers 80 and 90. Accordingly, the influence of the protection layer 262 on the operation of the actuator section 100 can be further reduced.

In the process for manufacturing the liquid jet head 5000, after forming a protection layer 262, the protection layer 262 may be patterned to form the opening sections 264. At the same time, side sections of the capacitor structure section 61 may be patterned, whereby the protection layer 262 shown in FIG. 24 can be obtained. The patterning of the side sections of the capacitor structure section 61 and the patterning to form the opening section 264 may be the same process, or different processes. The patterning can be conducted by the known photolithography technique described above.

Other portions of the structure and method for manufacturing the liquid jet head 5000 in accordance with the second modified example are substantially the same as those of the structure and method for manufacturing the liquid jet head 3000 in accordance with the embodiment described above, and therefore their description is omitted.

3.3.3. Third Modified Example

Figure 25:
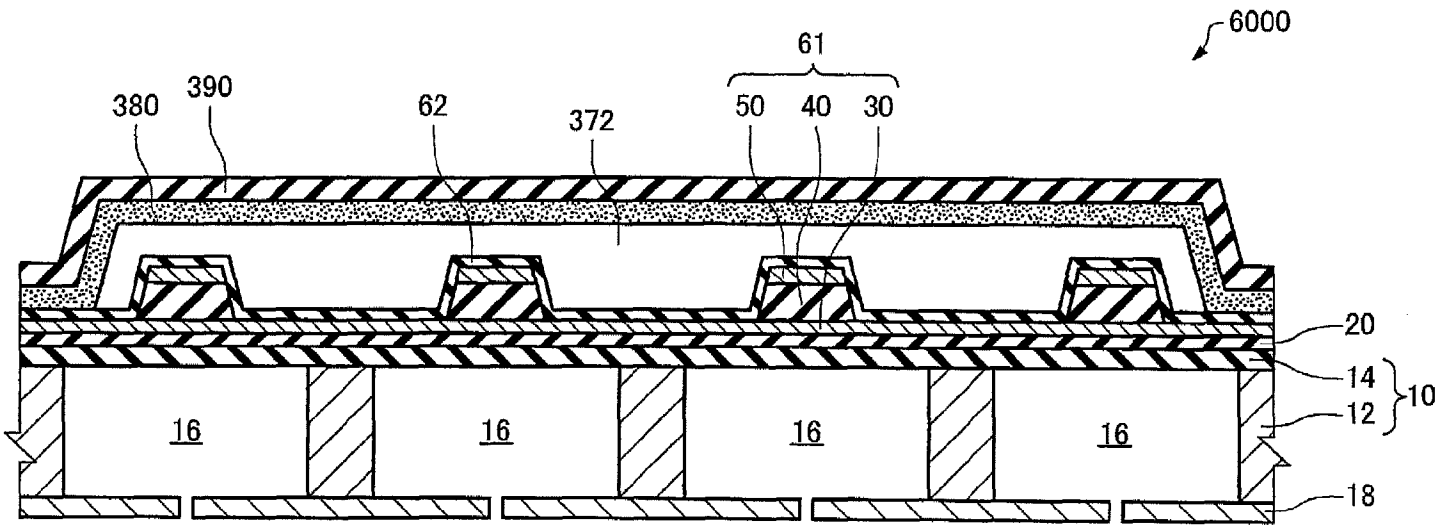
FIG. 25 is a schematic cross-sectional view showing a main part of a liquid jet head 6000 in accordance with a third modified example.

FIG. 25 is a schematic cross-sectional view of a liquid jet head 6000 in accordance with a third modified example, and corresponds to FIG. 13. The liquid jet head 6000 is different from the liquid jet head 5000 in accordance with the embodiment described above in that a plurality of (four in the illustrated example) capacitor structure sections 61 are provided in a single void section 372.

A void section 372 is provided between the protection layer 62 and the porous layer 380, and has a shape that covers a plurality of adjoining capacitor structure sections 61. The porous layer 380 and the seal layer 390 have a shape that covers the plurality of capacitor structure sections 61.

In the process for manufacturing the liquid jet head 6000, the step of forming a resist layer 70 is different from that of the process for manufacturing the liquid jet head 3000 described above.

Concretely, the difference lies in the step of forming the resist layer 70 described above in conjunction with the method for manufacturing a liquid jet head in accordance with the third embodiment. In accordance with the present modified example, a resist layer 70*a* that covers a plurality of capacitor structure sections 61 is provided, and the resist layer is patterned by a known photolithography technique, thereby forming the resist layer 70. In this instance, the plurality of capacitor structure sections 61 are embedded in the single patterned resist layer 70.

As the liquid jet head 6000 in accordance with the present embodiment has the structure described above, deterioration of the piezoelectric layer 40 of the capacitor structure section 61, which is a major factor of deterioration of the liquid jet head 6000, can be suppressed. In other words, the capacitor structure sections 61 in their entirety are provided inside the void section 372 sealed by the porous layer 380 and the seal layer 390, and therefore do not contact the atmosphere, such that deterioration of the piezoelectric layers 40 can be suppressed. In accordance with the present embodiment, in addition to the above, the void section 372 is in a reduced pressure state, and therefore there is little substance that may influence the piezoelectric layers 40, such that the effect of suppressing deterioration of the liquid jet head 6000 is greater.

According to the manufacturing method in accordance with the third modified example, deterioration of the capacitor structure sections 61, which is a major factor of deterioration of the liquid jet head 6000, can be avoided. In other words, the structure that covers the plurality of capacitor structure sections 61 can be formed continuously in a vacuum apparatus, such that the atmosphere and the capacitor structure sections 61 do not contact each other during this process.

Accordingly, there is no influence of water molecule on the piezoelectric layers 40 of the capacitor structure sections 61, and deterioration of the performance of the liquid jet head can be suppressed. Furthermore, the void section 372 is formed in a vacuum apparatus, such that the void section 372 can be placed in a reduced pressure state without having to apply other special processes.

Other portions of the structure and method for manufacturing the liquid jet head 6000 in accordance with the third modified example are substantially the same as those of the structure and method for manufacturing the liquid jet head 3000 in accordance with the embodiment described above, and therefore their description is omitted.

3.3.4. Fourth Modified Example

Figure 26:
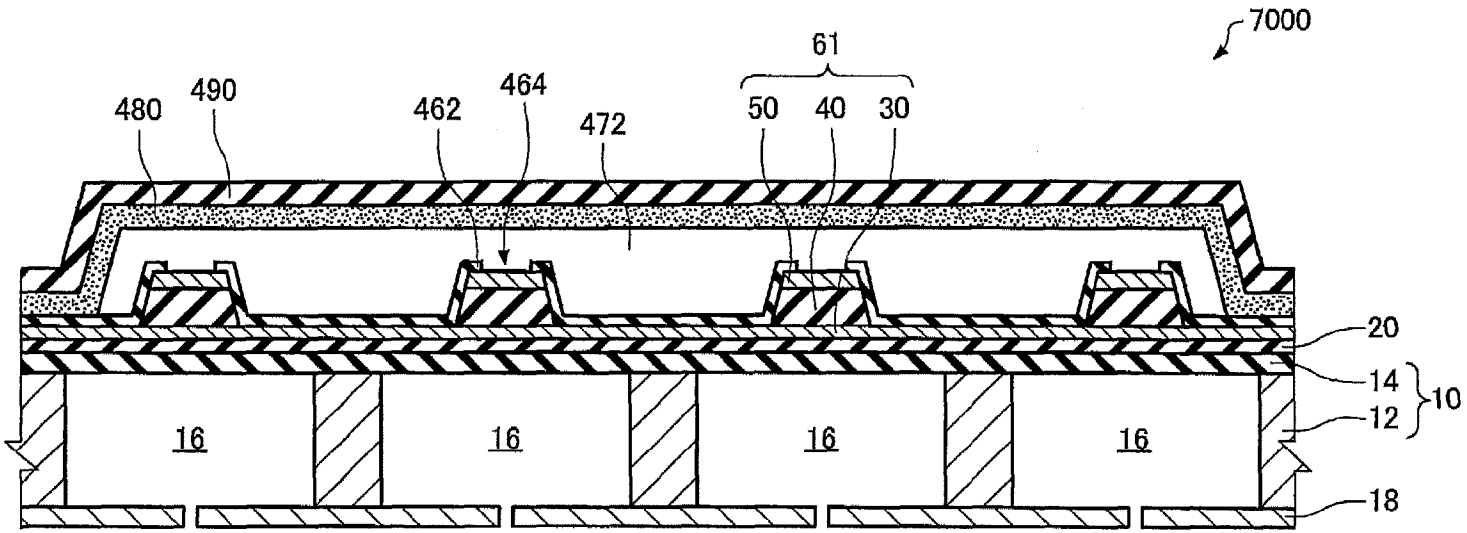
FIG. 26 is a schematic cross-sectional view showing a main part of a liquid jet head 7000 in accordance with a fourth modified example.

FIG. 26 is a schematic cross-sectional view of a liquid jet head 7000 in accordance with a fourth modified example, and corresponds to FIG. 13. The liquid jet head 7000 is different from the liquid jet head 3000 in accordance with the embodiment described above in that a plurality of (four in the illustrated example) capacitor structure sections 61 are provided in a single void section 472, and the protection layer 462 has opening sections 464 at the top surface of the upper electrode layers 50.

It is desirable to form the opening section 464 only at the top surface of each of the upper electrode layers 50 in a wide area as much as possible. By providing such an opening section 464, the contact area of the protection layer 462 contacting the capacitor structure section 61 can be made smaller, and the influence on the operation of the actuator section 100 can be further reduced.

After forming a protection layer 462, the protection layer 462 may be patterned to form the opening sections 464. The patterning can be conducted by the known photolithography technique described above.

A void section 472 is provided between the protection layer 462 and the porous layer 480, and has a shape that covers a plurality of adjoining capacitor structure sections 61. The porous layer 480 and the seal layer 490 have a shape that covers the plurality of capacitor structure sections 61.

In the process for manufacturing the liquid jet head 7000, the step of forming a resist layer 70 and the step of forming the protection layer 462 are different from those of the process for manufacturing the liquid jet head 3000 described above.

Concretely, the difference lies in the step of forming the protection layer 462 and the step of forming the resist layer 70 described above in conjunction with the method for manufacturing a liquid jet head in accordance with the third embodiment.

In the step of forming the protection layer 462, the opening sections 464 can be obtained through forming the protection layer 462 and thereafter patterning the protection layer 462. The patterning can be conducted by the known photolithography technique described above.

Also, in the step of forming the resist layer 70, a resist layer 70*a* that covers a plurality of capacitor structure sections 61 is provided, and the resist layer 70*a* is patterned by a known photolithography technique, thereby forming the resist layer 70. In this instance, the plurality of capacitor structure sections 61 are embedded in the single patterned resist layer 70.

As the liquid jet head 7000 in accordance with the present embodiment has the structure described above, deterioration of the piezoelectric layers 40 of the capacitor structure sections 61, which is a major factor of deterioration of the liquid jet head 7000, can be suppressed. In other words, the capacitor structure sections 61 in their entirety are provided inside the void section 472 sealed by the porous layer 480 and the seal layer 490, and therefore do not contact the atmosphere, such that deterioration of the piezoelectric layers 40 can be suppressed. Moreover, the void section 472 is in a reduced pressure state, and therefore there is little substance that may influence the piezoelectric layers 40, such that the effect of suppressing deterioration of the liquid jet head 7000 is greater.

According to the manufacturing method in accordance with the fourth modified example, deterioration of the capacitor structure sections 61, which is a major factor of deterioration of the liquid jet head 7000, can be avoided. In other words, the structure that covers the plurality of capacitor structure sections 61 can be formed continuously in a vacuum apparatus, such that the atmosphere and the capacitor structure sections 61 do not contact each other during this process. Accordingly, there is no influence of water molecule on the piezoelectric layers 40 of the capacitor structure sections 61, and deterioration of the performance of the liquid jet head can be suppressed. Furthermore, the void section 472 is formed in a vacuum apparatus, such that the void section 472 can be placed in a reduced pressure state without having to apply other special processes.

Other portions of the structure and method for manufacturing the liquid jet head 7000 in accordance with the fourth modified example are substantially the same as those of the structure and method for manufacturing the liquid jet head 3000 in accordance with the third embodiment described above, and therefore their description is omitted.

3.3.5. Fifth Modified Example

Figure 27:
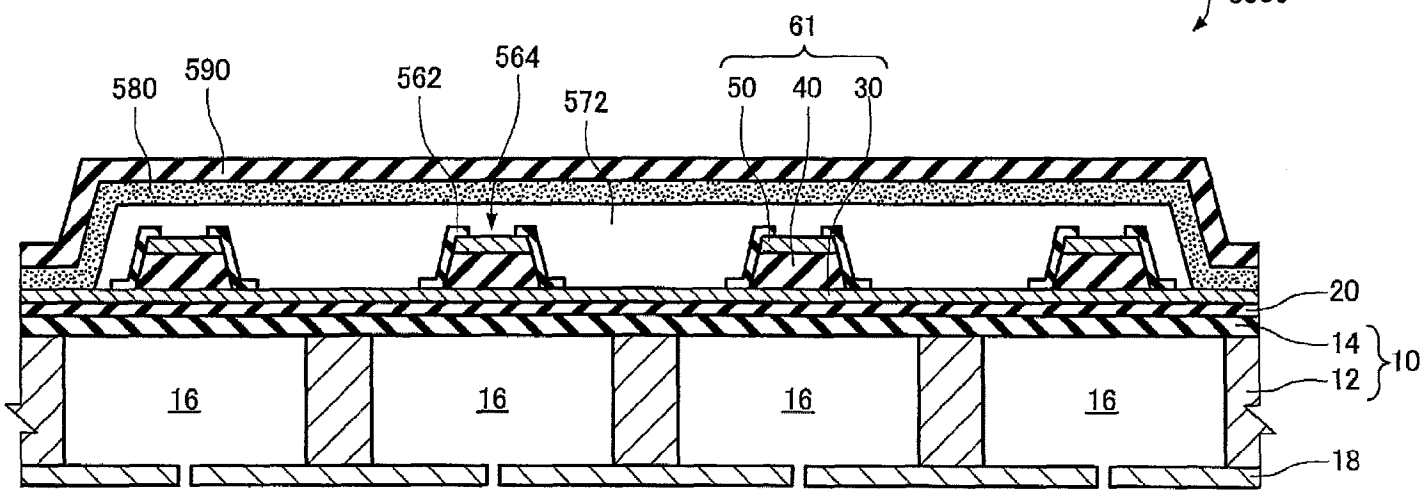
FIG. 27 is a schematic cross-sectional view showing a main part of a liquid jet head 8000 in accordance with a fourth modified example.

FIG. 27 is a schematic cross-sectional view of a liquid jet head 8000 in accordance with a fifth modified example, and corresponds to FIG. 13. The liquid jet head 8000 is different from the liquid jet head 3000 in accordance with the embodiment described above in that a plurality of (four in the illustrated example) capacitor structure sections 61 are provided in a single void section 572, the protection layer 562 has opening sections 564 at the top surface of the upper electrode layers 50, and the protection layer 562 is cut between adjacent ones of the capacitor structure sections 61.

It is desirable to form the opening section 564 only at the top surface of the upper electrode layer 50 in a wide area as much as possible. By providing such an opening section 564, the contact area of the protection layer 562 contacting the capacitor structure section 61 can be made smaller, and the influence on the operation of the actuator section 100 can be further reduced.

After forming a protection layer 562, the protection layer 562 may be patterned to form the opening sections 564. The patterning can be conducted by the known photolithography technique described above.

Also, the protection layer 562 does not contact the porous layer 580 or the seal layer 590, and is cut between adjacent ones of the capacitor structure sections 61. In other words, the protection layer 562 is completely covered by the void section 572. As the protection layer 562 is not in contact with the porous layer 580 or the seal layer 590, movements thereof are not restricted by these layers 580 and 590. Accordingly, the influence of the protection layer 562 on the operation of the actuator section 100 can be further reduced.

A void section 572 is provided between the protection layer 562 and the porous layer 580, and has a shape that covers a plurality of adjoining capacitor structure sections 61. The porous layer 580 and the seal layer 590 have a shape that covers the plurality of capacitor structure sections 61.

The method for manufacturing the liquid jet head 8000 is different from the method for manufacturing the liquid jet head 300 described above in the step for forming the resist layer 70 and the step of forming the protection layer 562.

Concretely, the difference lies in the step of forming the protection layer 562 and the step of forming the resist layer 70 described above in conjunction with the method for manufacturing a liquid jet head in accordance with the third embodiment.

In the process for manufacturing the liquid jet head 8000, after forming the protection layer 562, the opening sections 564 can be obtained through patterning the protection layer 562. At the same time, side sections of the capacitor structure section 61 may be patterned, whereby the protection layer 562 shown in FIG. 27 can be obtained. The patterning of the side sections of the capacitor structure section 61 and the patterning to form the opening sections 564 may be the same process, or different processes. The patterning can be conducted by the known photolithography technique described above.

Also, in the step of forming the resist layer 70, a resist layer 70*a* that covers a plurality of capacitor structure sections 61 is provided, and the resist layer 70*a* is patterned by a known photolithography technique, thereby forming the resist layer 70. In this instance, the plurality of capacitor structure sections 61 are embedded in the patterned single resist layer 70.

As the liquid jet head 8000 has the structure described above, deterioration of the piezoelectric layers 40 of the capacitor structure sections 61, which is a major factor of deterioration of the liquid jet head 8000, can be suppressed. In other words, the capacitor structure sections 61 in their entirety are provided inside the void section 572 sealed by the porous layer 580 and the seal layer 590, and therefore do not contact the atmosphere, such that deterioration of the piezoelectric layers 40 can be suppressed. Moreover, the void section 572 is in a reduced pressure state, and therefore there is little substance that may influence the piezoelectric layers 40, such that the effect of suppressing deterioration of the liquid jet head 8000 is greater.

According to the manufacturing method in accordance with the fifth modified example, deterioration of the capacitor structure sections 61, which is a major factor of deterioration of the liquid jet head 8000, can be avoided. In other words, the structure that covers the plurality of capacitor structure sections 61 can be formed continuously in a vacuum apparatus, such that the atmosphere and the capacitor structure sections 61 do not contact each other during this process. Accordingly, there is no influence of water molecule on the piezoelectric layers 40 of the capacitor structure sections 61, and deterioration of the performance of the liquid jet head can be suppressed. Furthermore, the void section 572 is formed in a vacuum apparatus, such that the void section 572 can be placed in a reduced pressure state without having to apply other special processes.

Other portions of the structure and method for manufacturing the liquid jet head 8000 in accordance with the fifth modified example are substantially the same as those of the structure and method for manufacturing the liquid jet head 3000 in accordance with the embodiment described above, and therefore their description is omitted.

The invention is not limited to the embodiments described above, and many modifications can be made. For example, the invention may include compositions that are substantially the same as the compositions described in the embodiments (for example, a composition with the same function, method and result, or a composition with the same object and result). Also, the invention includes compositions in which portions not essential in the compositions described in the embodiments are replaced with others. Also, the invention includes compositions that achieve the same functions and effects or achieve the same objects of those of the compositions described in the embodiments. Furthermore, the invention includes compositions that include publicly known technology added to the compositions described in the embodiments.

The embodiments of the invention are described above in detail. However, those skilled in the art should readily understand that many modifications can be made without departing in substance from the novel matter and effects of the invention. Accordingly, those modified examples are also included in the scope of the invention.

Japanese Patent Application 2006-211111, filed on Aug. 2, 2006 and Japanese Patent Application 2006-316720, filed on Nov. 24, 2006 are hereby incorporated by reference in their entirety.

What is claimed is:

1. A liquid jet head comprising:

a substrate;

a pressure generation chamber provided in the substrate;

an elastic plate provided above the substrate;

a capacitor structure section provided above the elastic plate, the capacitor structure section including a lower electrode layer, a piezoelectric layer and an upper electrode layer;

a porous layer provided above the capacitor structure section;

a seal layer provided on the porous layer; and a void section formed between the capacitor structure section and the porous layer.

2. A liquid jet head according to claim 1, further comprising a protection layer provided at least on a side surface of the capacitor structure section.

3. A liquid jet head according to claim 2, wherein the protection layer has an opening section in an upper surface of the capacitor structure section.

4. A liquid jet head according to claim 2, wherein the protection layer is formed on the upper surface and the side surface of the capacitor structure section.

5. A liquid jet head according to claim 2, wherein the protection layer has a film thickness smaller than a film thickness of the seal layer.

6. A liquid jet head according to claim 2, wherein the film thickness of the protection layer is 0.1 μm or less.

7. A liquid jet head according to claim 1, wherein the porous layer is provided without contacting the capacitor structure section.

8. A liquid jet head according to claim 1, wherein the void section has a pressure smaller than the atmospheric pressure.

9. A liquid jet head according to claim 1, wherein the substrate has a dielectric layer at an upper section thereof.

10. A liquid jet head according to claim 1, wherein the porous layer is composed of a material selected from the group consisting of oxide, nitride and organic substance.

11. A liquid jet head according to claim 10, wherein the oxide is aluminum oxide.

12. A liquid jet head according to claim 1, wherein the capacitor structure section in singularity is provided in the void section in singularity.

13. A liquid jet head according to claim 1, wherein the capacitor structure sections in plurality are provided in the void section in singularity.

14. A method for manufacturing a liquid jet head, comprising the steps of:

(a) sequentially forming, above a substrate, an elastic plate, a lower electrode layer, a piezoelectric layer and an upper electrode layer;

(b) patterning the piezoelectric layer and the upper electrode layer to thereby form a capacitor structure section;

(c) forming a resist layer that covers the capacitor structure section;

(d) forming a porous layer that covers the resist layer;

(e) supplying a gas through pores of the porous layer to remove the resist layer by an ashing method;

(f) forming a seal layer that covers the porous layer; and (g) forming a pressure generation chamber in the substrate.

15. A method for manufacturing a liquid jet head according to claim 14, further comprising, between the steps (b) and (c), the step (h) of forming a protection layer that covers the capacitor structure section, wherein, in the step (c), the resist layer that covers the capacitor structure section and the protection layer is formed.

16. A method for manufacturing a liquid jet head according to claim 15, wherein a portion of the protection layer formed on an upper surface of the capacitor structure section is removed by patterning the protection layer between the step (h) and the step (c).

* * * * *